US012553312B2

(12) United States Patent
Rong et al.

(10) Patent No.: US 12,553,312 B2
(45) Date of Patent: Feb. 17, 2026

(54) AUTONOMOUS FLOW CONTROL SYSTEMS HAVING BYPASS FUNCTIONALITY

(71) Applicant: Floway Innovations Inc., Plano, TX (US)

(72) Inventors: Xinqi Rong, Dallas, TX (US); Liang Zhao, Allen, TX (US)

(73) Assignee: Floway Innovations, Inc., Plano, TX (US)

( * ) Notice: Subject to any disclaimer, the term of this patent is extended or adjusted under 35 U.S.C. 154(b) by 0 days.

(21) Appl. No.: 18/894,942

(22) Filed: Sep. 24, 2024

(65) Prior Publication Data

US 2025/0012170 A1 Jan. 9, 2025

Related U.S. Application Data

(63) Continuation-in-part of application No. 18/140,607, filed on Apr. 27, 2023, now Pat. No. 12,104,458, which is a continuation-in-part of application No. 17/869,167, filed on Jul. 20, 2022, now Pat. No. 11,639,645, which is a continuation of application No. 16/900,895, filed on Jun. 13, 2020, now Pat. No. 11,428,072, which is a continuation-in-part of application No. 16/520,596, filed on Jul. 24, 2019,
(Continued)

(51) Int. Cl.

| | |
|---|---|
| ***E21B 34/08*** | (2006.01) |
| ***E21B 43/08*** | (2006.01) |
| ***E21B 43/12*** | (2006.01) |
| ***E21B 49/08*** | (2006.01) |

(52) U.S. Cl.

CPC ..... *E21B 34/08* (2013.01); *E21B 43/08* (2013.01); *E21B 43/12* (2013.01); *E21B 49/08* (2013.01); *E21B 49/0875* (2020.05); *E21B 2200/02* (2020.05)

(58) Field of Classification Search

CPC ..... E21B 34/08; E21B 43/08; E21B 43/12; E21B 43/14; E21B 49/08; E21B 49/0875; E21B 2200/02

See application file for complete search history.

(56) References Cited

U.S. PATENT DOCUMENTS 2,579,334 A 12/1951 Norris
5,234,025 A 8/1993 Skoglund et al.
(Continued)

OTHER PUBLICATIONS

Miersma, Matthew; Analysis of Inflow Control Devices for Steam Assisted Gravity Drainage Using Computational Fluid Dynamics; Department of Mechanical Engineering—University of Alberta; 2018.

*Primary Examiner* — George S Gray
(74) *Attorney, Agent, or Firm* — Lawrence Youst PLLC

(57) ABSTRACT

A downhole fluid flow control system positionable in a wellbore. The flow control system includes a completion string with a plurality of flow control tubulars and at least one bypass tubular positioned therein. Each of the flow control tubulars includes at least one autonomous inflow control device configured to allow production of a formation fluid when the formation fluid is a desired fluid and to choke production of the formation fluid when the formation fluid is an undesired fluid. The at least one bypass tubular includes at least one bypass valve that is operated from a closed position to an open position to provide a path for the formation fluid to bypass the autonomous inflow control devices.

20 Claims, 12 Drawing Sheets

Related U.S. Application Data now Pat. No. 10,711,569, which is a continuation-in-part of application No. 16/206,512, filed on Nov. 30, 2018, now Pat. No. 10,364,646, which is a continuation of application No. 16/048,328, filed on Jul. 29, 2018, now Pat. No. 10,174,588, which is a continuation of application No. 15/855,747, filed on Dec. 27, 2017, now Pat. No. 10,060,221.

(56) References Cited

U.S. PATENT DOCUMENTS

| | | | | |
|---|---|---|---|---|
| 6,786,285 | B2 | 9/2004 | Johnson et al. | |
| 7,823,645 | B2 | 11/2010 | Henriksen et al. | |
| 7,870,906 | B2 | 1/2011 | Ali | |
| 8,191,627 | B2 | 6/2012 | Hamid et al. | |
| 8,235,128 | B2 | 8/2012 | Dykstra et al. | |
| 8,291,976 | B2 | 10/2012 | Schultz et al. | |
| 8,356,668 | B2 | 1/2013 | Dykstra et al. | |
| 8,584,762 | B2 | 11/2013 | Fripp et al. | |
| 8,602,106 | B2 | 12/2013 | Lopez | |
| 8,622,136 | B2 | 1/2014 | Dykstra et al. | |
| 8,752,629 | B2 | 6/2014 | Moen | |
| 8,820,413 | B2 | 9/2014 | Mathiesen et al. | |
| 8,875,797 | B2 | 11/2014 | Aakre et al. | |
| 8,931,566 | B2 | 1/2015 | Dykstra et al. | |
| 9,109,423 | B2 | 8/2015 | Dykstra et al. | |
| 9,187,991 | B2 | 11/2015 | Fripp et al. | |
| 9,249,649 | B2 | 2/2016 | Fripp et al. | |
| 9,394,759 | B2 | 7/2016 | Fripp et al. | |
| 9,404,349 | B2 | 8/2016 | Zhao | |
| 9,556,706 | B1 | 1/2017 | Zhao | |
| 9,683,429 | B2 | 6/2017 | Mathiesen et al. | |
| 9,759,042 | B2 | 9/2017 | Zhao | |
| 9,759,043 | B2 | 9/2017 | Zhao | |
| 10,060,221 | B1 | 8/2018 | Rong et al. | |
| 10,174,588 | B1 | 1/2019 | Rong et al. | |
| 10,214,991 | B2 | 2/2019 | Petegem et al. | |
| 10,364,646 | B2 | 7/2019 | Rong et al. | |
| 10,711,569 | B2 | 7/2020 | Rong et al. | |
| 2009/0145609 | A1 | 6/2009 | Holmes et al. | |
| 2011/0067878 | A1 | 3/2011 | Aadnoy | |
| 2011/0139453 | A1 | 6/2011 | Schultz et al. | |
| 2011/0198097 | A1 | 8/2011 | Moen | |
| 2012/0152527 | A1 | 6/2012 | Dykstra et al. | |
| 2012/0255740 | A1 | 10/2012 | Fripp et al. | |
| 2013/0092393 | A1 | 4/2013 | Dykstra et al. | |
| 2013/0112423 | A1 | 5/2013 | Dykstra et al. | |
| 2013/0186634 | A1 | 7/2013 | Fripp et al. | |
| 2013/0228341 | A1* | 9/2013 | Fripp | E21B 43/12 166/373 |
| 2013/0277059 | A1* | 10/2013 | Holderman | E21B 43/12 166/373 |
| 2014/0110128 | A1 | 4/2014 | Dykstra et al. | |
| 2014/0216733 | A1 | 8/2014 | Mathiesen et al. | |
| 2015/0021019 | A1 | 1/2015 | Veit | |
| 2015/0040990 | A1* | 2/2015 | Mathiesen | E21B 34/08 137/12 |
| 2015/0060084 | A1 | 3/2015 | Moen et al. | |
| 2016/0061004 | A1 | 3/2016 | Tunkiel et al. | |
| 2016/0061373 | A1 | 3/2016 | Russell et al. | |
| 2017/0044868 | A1 | 2/2017 | Petegem et al. | |
| 2017/0234106 | A1 | 8/2017 | Mathiesen et al. | |
| 2017/0306738 | A1* | 10/2017 | Voll | E21B 43/32 |
| 2019/0195047 | A1* | 6/2019 | Rong | E21B 43/08 |
| 2019/0345793 | A1 | 11/2019 | Rong et al. | |
| 2020/0308931 | A1 | 10/2020 | Rong et al. | |
| 2024/0271509 | A1* | 8/2024 | Rudic | E21B 34/08 |

* cited by examiner

AUTONOMOUS FLOW CONTROL SYSTEMS HAVING BYPASS FUNCTIONALITY

CROSS-REFERENCE TO RELATED APPLICATIONS

The present application is a continuation-in-part of application Ser. No. 18/140,607 filed Apr. 27, 2023, which is a continuation-in-part of application Ser. No. 17/869,167 filed Jul. 20, 2022, now U.S. Pat. No. 11,639,645, which is a continuation of application Ser. No. 16/900,895 filed Jun. 13, 2020, now U.S. Pat. No. 11,428,072, which is a continuation-in-part of application Ser. No. 16/520,596 filed Jul. 24, 2019, now U.S. Pat. No. 10,711,569, which is a continuation-in-part of application Ser. No. 16/206,512 filed Nov. 30, 2018, now U.S. Pat. No. 10,364,646, which is a continuation of application Ser. No. 16/048,328 filed Jul. 29, 2018, now U.S. Pat. No. 10,174,588, which is a continuation of application Ser. No. 15/855,747 filed Dec. 27, 2017, now U.S. Pat. No. 10,060,221, the entire contents of each is hereby incorporated by reference.

TECHNICAL FIELD OF THE DISCLOSURE

The present disclosure relates, in general, to flow control systems used during the production of fluids from hydrocarbon bearing subterranean formations and, in particular, to downhole fluid flow control systems that include bypass valves that are operatable to increase the production rate from a well that is being choked by autonomous inflow control devices.

BACKGROUND

During the completion of a well that intersects a hydrocarbon bearing subterranean formation, production tubing and various completion equipment are installed in the well to enable safe and efficient production of the formation fluids. For example, to control the flowrate of production fluids into the production tubing, it is common practice to install a fluid flow control system within the tubing string including one or more inflow control devices such as flow tubes, nozzles, labyrinths or other tortuous path devices. Typically, the production flowrate through these inflow control devices is fixed prior to installation based upon the design thereof. It has been found, however, that due to changes in formation pressure and changes in formation fluid composition over the life of the well, it may be desirable to adjust the flow control characteristics of the inflow control devices. It has also been found that it may be desirable to adjust the flow control characteristics of the inflow control devices without the requirement for well intervention. In addition, for certain completions, such as long horizontal completions that have numerous production intervals, it may be desirable to independently control the inflow of production fluids into each of the production intervals.

Attempts have been made to achieve these results through the use of autonomous inflow control devices. For example, such autonomous inflow control devices typically include a valve element that is fully open responsive to the flow of a desired fluid, such as oil, but restricts production responsive to the flow of an undesired fluid, such as water or gas. It has been found, however, that when a well begins to produce a high water cut along most of its length, the autonomous inflow control devices choke production across the entire completion. If an operator wants to continue production even with the high water cut, current fluid flow control systems utilizing autonomous inflow control devices severely limit the production rate. Accordingly, a need has arisen for a downhole fluid flow control system that is operable to independently control the inflow of production fluids from multiple production intervals without the requirement for well intervention as the composition of the fluids produced into specific intervals changes over time. A need has also arisen for such a downhole fluid flow control system that allows for the production of fluid with a high water cut at a desired production rate once the well is producing a high water cut fluid along most of its length.

SUMMARY

In a first aspect, the present disclosure is directed to a downhole fluid flow control system that is positionable in a wellbore. The flow control system includes a completion string. A plurality of flow control tubulars is positioned in the completion string. Each of the flow control tubulars includes at least one autonomous inflow control device configured to allow production of a formation fluid when the formation fluid is a desired fluid and to choke production of the formation fluid when the formation fluid is an undesired fluid. At least one bypass tubular is positioned in the completion string. The at least one bypass tubular includes at least one bypass valve that is operated from a closed position to an open position responsive to a predetermined opening differential pressure between a wellbore pressure and a tubing pressure to provide a path for the formation fluid to bypass the autonomous inflow control devices. The at least one bypass valve is operated from the open position to the closed position responsive to a predetermined closing differential pressure between the wellbore pressure and the tubing pressure with the predetermined closing differential pressure being less than the predetermined opening differential pressure.

In certain embodiments, there may be a greater number of the flow control tubulars than the bypass tubulars in the completion string. In some embodiments, each of the flow control tubulars may be a flow control screen assembly. In certain embodiments, each of the bypass tubulars may be a bypass screen assembly. In some embodiments, first and second annular barriers may be positioned in the completion string and may be configured to have a sealing relationship with the wellbore to define a production interval therebetween. In such embodiments, the flow control tubulars and the at least one bypass tubular may be positioned in the completion string between the first and second annular barriers. In certain embodiments, the completion string may define first and second production intervals. In such embodiments, at least some of the flow control tubulars may be positioned in the first production interval and the at least one bypass tubular may be positioned in the second production interval.

In some embodiments, each autonomous inflow control device may include a housing having upstream and downstream sides; a main fluid pathway extending between the upstream and downstream sides; a secondary fluid pathway extending between the upstream and downstream sides in parallel with the main fluid pathway; a valve element disposed within the housing, the valve element operable between an open position wherein fluid flow through the main fluid pathway is allowed and a closed position wherein fluid flow through the main fluid pathway is prevented; a viscosity discriminator disposed within the housing, the viscosity discriminator having a viscosity sensitive channel that forms at least a portion of the secondary fluid pathway; and a differential pressure switch operable to shift the valve element between the open and closed positions, the differential pressure switch including a first pressure signal from the upstream side, a second pressure signal from the downstream side and a third pressure signal from the secondary fluid pathway, the first and second pressure signals biasing the valve element toward the open position, the third pressure signal biasing the valve element toward the closed position; wherein, a magnitude of the third pressure signal is dependent upon the viscosity of the formation fluid flowing through the secondary fluid pathway; and wherein, the differential pressure switch is operated responsive to changes in the viscosity of the formation fluid, thereby controlling fluid flow through the main fluid pathway. In such embodiments, the valve element of each autonomous inflow control device may have first, second and third areas wherein, the first pressure signal acts on the first area, the second pressure signal acts on the second area and the third pressure signal acts on the third area such that the differential pressure switch is operated responsive to a difference between the first pressure signal times the first area plus the second pressure signal times the second area and the third pressure signal times the third area.

In certain embodiments, the at least one bypass valve may include a housing having at least one inlet and at least one outlet; a main fluid pathway extending between the at least one inlet and the at least one outlet; a valve element disposed within the housing, the valve element operable between an open position wherein fluid flow through the main fluid pathway is allowed and a closed position wherein fluid flow through the main fluid pathway is prevented; and a biasing element configured to urge the valve element toward the closed position; wherein, a differential pressure between the at least one inlet and the at least one outlet acts on the valve element to operate the valve element between the open and closed positions. In such embodiments, the valve element may have an upper surface with first and second areas such that the wellbore pressure acts on only the first area when the valve element is in the closed position and the wellbore pressure acts on both the first and second areas when the valve element is in the open position.

In a second aspect, the present disclosure is directed to a downhole fluid flow control system that is positionable in a wellbore. The flow control system includes a completion string. A plurality of flow control tubulars is positioned in the completion string. Each of the flow control tubulars includes at least one autonomous inflow control device configured to allow production of a formation fluid when the formation fluid is a desired fluid and to choke production of the formation fluid when the formation fluid is an undesired fluid. At least one bypass tubular is positioned in the completion string. The at least one bypass tubular includes at least one bypass valve that is operated from a closed position to an open position responsive to an opening pressure signal to provide a path for the formation fluid to bypass the autonomous inflow control devices. In some embodiments, the at least one bypass valve may be operated from the open position to the closed position responsive to a closing pressure signal that is less than the opening pressure signal.

In a third aspect, the present disclosure is directed to a downhole fluid flow control system that is positionable in a wellbore. The flow control system includes a completion string. A plurality of flow control tubulars is positioned in the completion string. Each of the flow control tubulars includes at least one autonomous inflow control device configured to allow production of a formation fluid when the formation fluid is a desired fluid and to choke production of the formation fluid when the formation fluid is an undesired fluid. At least one bypass tubular is positioned in the completion string. The at least one bypass tubular includes at least one bypass valve that is operated from a closed position to an open position to provide a path for the formation fluid to bypass the autonomous inflow control devices.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, and the like described herein may be positioned in any desired orientation. Thus, the use of terms such as "above," "below," "upper," "lower" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. As used herein, the term "coupled" may include direct or indirect coupling by any means, including moving and/or non-moving mechanical connections.

Figure 1A:
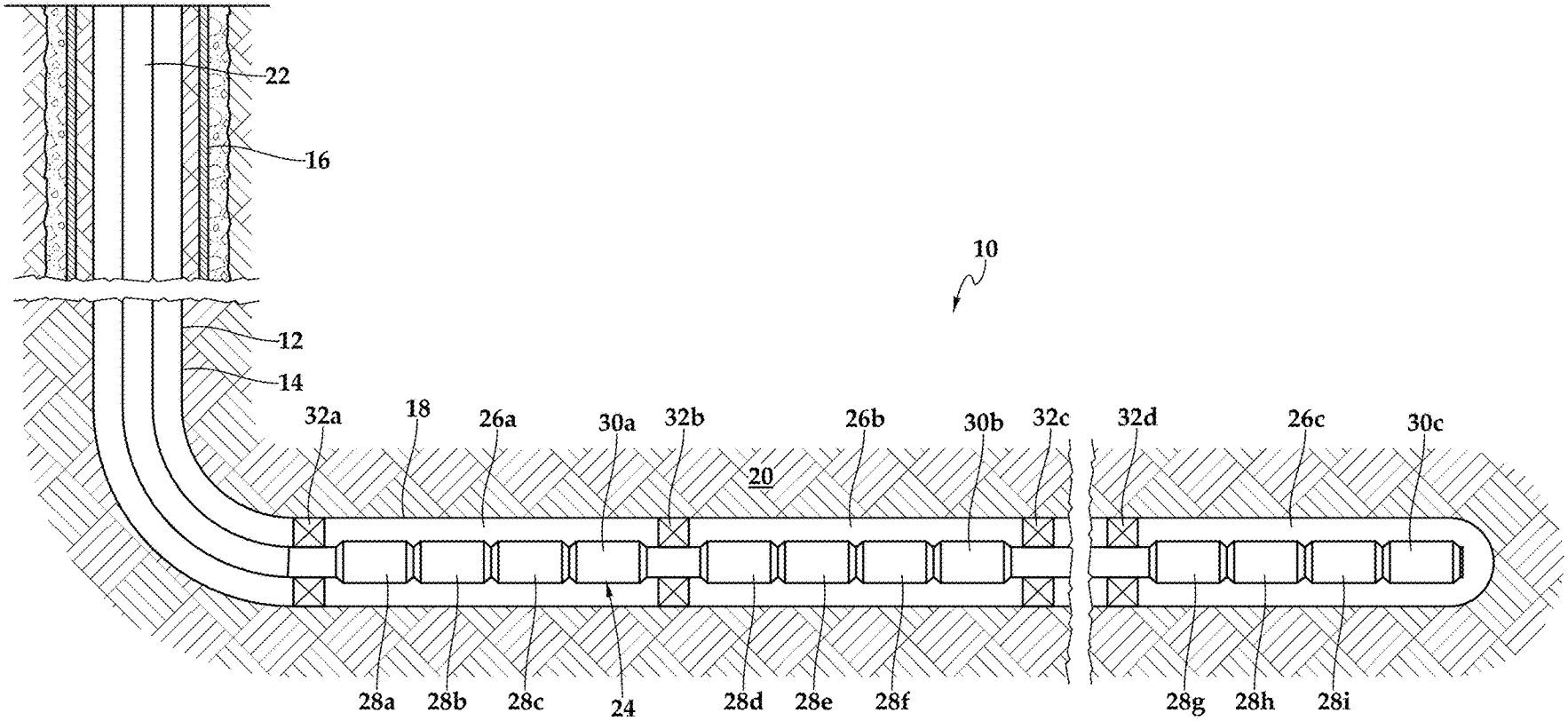
FIGS. 1A-1B are schematic illustrations of well systems operating a completion string including plurality of flow control screen assemblies having autonomous inflow control devices and a plurality of bypass screen assemblies having bypass valves according to embodiments of the present disclosure.

Referring initially to FIG. 1A, therein is depicted a well system including a plurality of flow control screen assemblies including autonomous inflow control devices and a plurality of bypass screen assemblies including bypass valves embodying principles of the present disclosure that is schematically illustrated and generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and/or for injection fluids to travel from the surface to formation 20. At its lower end, tubing string 22 is coupled to a completion string 24 that has been installed in wellbore 12 and divides the completion interval into a plurality of production intervals such as production intervals 26*a*, 26*b*, 26*c* that are adjacent to formation 20 with the break between production intervals 26*b*, 26*c* indicating any number of additional production intervals that may be located therebetween. Completion string 24 includes a plurality of flow control tubulars having autonomous inflow control devices associated therewith and a plurality of bypass tubulars having bypass valves associated therewith. More specifically, flow control screen assemblies 28*a*, 28*b*, 28*c* in production interval 26*a* include autonomous inflow control devices and bypass screen assembly 30*a* in production interval 26*a* includes a bypass valve. Similarly, flow control screen assemblies 28*d*, 28*e*, 28*f* in production interval 26*b* include autonomous inflow control devices and bypass screen assembly 30*b* in production interval 26*b* includes a bypass valve. In addition, flow control screen assemblies 28*g*, 28*h*, 28*i* in production interval 26*c* include autonomous inflow control devices and bypass screen assembly 30*c* in production interval 26*c* includes a bypass valve. Flow control screen assemblies 28*a*-28*i* may collectively or generically be referred to as flow control screen assemblies 28. Likewise, bypass screen assemblies 30*a*-30*c* may collectively or generically be referred to as bypass screen assemblies 30.

Production interval 26*a* is defined as the production zone of formation 20 between a pair of annular barriers depicted as packers 32*a*, 32*b* that provide a fluid seal between completion string 24 and wellbore 12. Similarly, production interval 26*b* is defined as the production zone of formation 20 between a pair of annular barriers depicted as packers 32*b*, 32*c* that provide a fluid seal between completion string 24 and wellbore 12. In addition, production interval 26*c* is defined as the production zone of formation 20 between the toe of wellbore 12 and an annular barrier depicted as packer 32*d* that provides a fluid seal between completion string 24 and wellbore 12. In the illustrated embodiment, flow control screen assemblies 28 serve to filter particulate matter out of the production fluid stream when the autonomous inflow control devices of completion string 24 are controlling the inflow of production fluids responsive to a fluid property of the formation fluid being produced such as the viscosity and/or density of the formation fluid. Similarly, bypass screen assemblies 30 serve to filter particulate matter out of the production fluid stream when the bypass valves of completion string 24 are allowing bypass flow of the formation fluid around the autonomous inflow control devices of completion string 24.

More specifically, the autonomous inflow control devices in flow control screen assemblies 28 are operable to control the inflow of production fluid during the initial phases of well operations while the bypass valves in bypass screen assemblies 30 are in their closed positions to prevent production therethrough. During an initial time period when the production fluid has a high percentage of oil, the autonomous inflow control devices in flow control screen assemblies 28 tend to balance production from each of the production intervals along completion string 24. As the well matures and undesired fluids such as water and/or gas break through certain of the production intervals, the autonomous inflow control devices in flow control screen assemblies 28 tend to choke production from those production intervals experiencing break through while allowing full production from those production intervals not experiencing break through, thereby maximizing the production of oil relative to water and/or gas. As the well further matures and the well begins to produce a high cut of the undesired fluid in most or all of the production intervals, the autonomous inflow control devices in flow control screen assemblies 28 tend to choke production along the entire completion string resulting in an increasingly lower volume of oil production.

If an operator wants to maintain or increase the oil production even with the high cut of the undesired fluid, the operator may increase drawdown pressure in an effort to increase production. This increase in drawdown pressure will tend to increase the differential pressure between the wellbore pressure (the pressure in the annulus between completion string 24 and wellbore 12) and the tubing pressure (the pressure inside completion string 24) which acts across flow control screen assemblies 28 and bypass screen assemblies 30. In the present embodiments, increasing the differential pressure acting across bypass screen assemblies 30 to a predetermined opening differential pressure will cause the bypass valves in bypass screen assemblies 30 to operate from the closed position to the open position, thereby allowing production therethrough which bypasses the autonomous inflow control devices. Once the bypass valves in bypass screen assemblies 30 are open, the operator can produce a desired volume of oil even though the production fluid has a high cut of an undesired fluid by increasing the flowrate to a desired level which may be much greater than the flowrate through the autonomous inflow control devices. The bypass valves in bypass screen assemblies 30 preferable stay open until the differential pressure across bypass screen assemblies 30 is decreased to a predetermined closing differential pressure which will cause the bypass valves in bypass screen assemblies 30 to operate from the open position to the closed position. For example, the predetermined opening differential pressure may be between 300 psi and 900 psi, such as between 400 psi and 700 psi or about 500 psi. Likewise, for example, the predetermined closing differential pressure may be between 100 psi and 400 psi, such as between 150 psi and 300 psi or about 200 psi. There should be a suitable hysteresis between the predetermined opening differential pressure and the predetermined closing differential pressure to avoid valve chatter or other unwanted valve operations. Accordingly, the hysteresis pressure may be between 200 psi and 500 psi, such as between 250 psi and 400 psi or about 300 psi.

Even though FIG. 1A depicts screen assemblies 28, 30 of the present disclosure in a horizontal open hole environment, it should be understood by those having ordinary skill in the art that the screen assemblies of the present disclosure are equally well suited for use in cased wells and in wells having other directional configurations including vertical wells, deviated wells, slanted wells, multilateral wells and the like. Also, even though FIG. 1A depicts each production interval as having three flow control screen assemblies 28 and one bypass screen assembly 30, it should be understood by those having ordinary skill in the art that any number of flow control screen assemblies 28 and any number of bypass screen assemblies 30 may be deployed within a given production interval without departing from the principles of the present disclosure. In addition, even though FIG. 1A depicts a uniform number of screen assemblies 28, 30 in each production interval, it should be understood by those having ordinary skill in the art that different numbers of screen assemblies 28, 30 may be deployed within different production intervals of a well without departing from the principles of the present disclosure. Further, even though FIG. 1A depicts a 3 to 1 ratio of flow control screen assemblies 28 to bypass screen assemblies 30 in each production interval, it should be understood by those having ordinary skill in the art that flow control screen assemblies 28 and bypass screen assemblies 30 may be deployed in any ratio without departing from the principles of the present disclosure. For example, the ratio of flow control screen assemblies 28 to bypass screen assemblies 30 may be between 2 to 1 and 10 to 1 such as between 4 to 1 and 9 to 1 or between 6 to 1 and 8 to 1. Finally, even though the autonomous inflow control devices have been described as being part of flow control screen assemblies 28 and the bypass valves have been described as being part of bypass screen assemblies 30, it should be understood by those having ordinary skill in the art that the autonomous inflow control devices and the bypass valves could be installed in tubulars that do not include filtering capabilities without departing from the principles of the present disclosure.

Figure 1B:
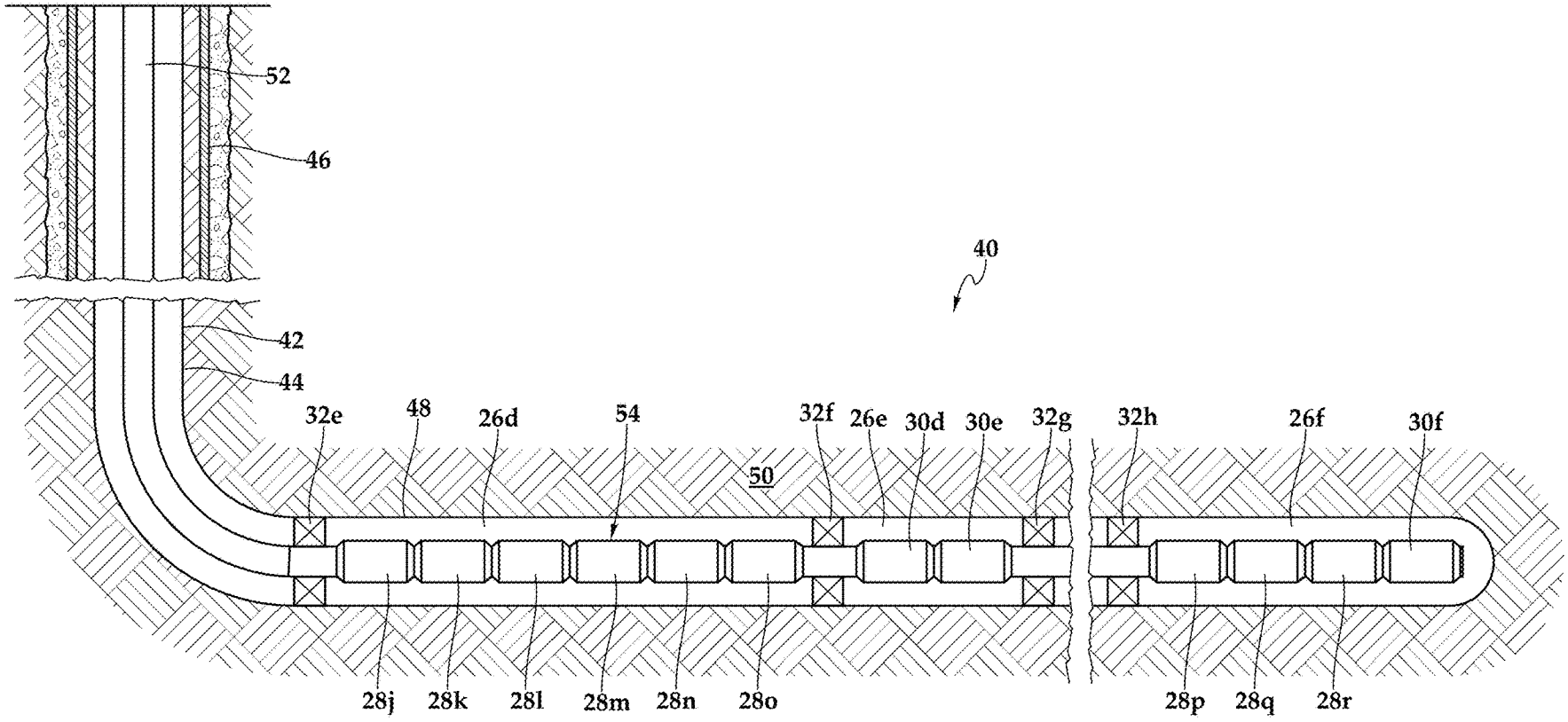

Referring next to FIG. 1B, therein is depicted a well system including a plurality of flow control screen assemblies including autonomous inflow control devices and a plurality of bypass screen assemblies including bypass valves embodying principles of the present disclosure that is schematically illustrated and generally designated 40. In the illustrated embodiment, a wellbore 42 extends through the various earth strata. Wellbore 42 has a substantially vertical section 44, the upper portion of which has cemented therein a casing string 46. Wellbore 42 also has a substantially horizontal section 48 that extends through a hydrocarbon bearing subterranean formation 50. As illustrated, substantially horizontal section 48 of wellbore 42 is open hole.

Positioned within wellbore 42 and extending from the surface is a tubing string 52. Tubing string 52 provides a conduit for formation fluids to travel from formation 50 to the surface and/or for injection fluids to travel from the surface to formation 50. At its lower end, tubing string 52 is coupled to a completion string 54 that has been installed in wellbore 52 and divides the completion interval into a plurality of production intervals such as production intervals 26*d*, 26*e*, 26*f* that are adjacent to formation 50 with the break between production intervals 26*e*, 26*f* indicating any number of additional production intervals that may be located therebetween. Completion string 54 includes a plurality of flow control screen assemblies having autonomous inflow control devices associated therewith and a plurality of bypass screen assemblies having bypass valves associated therewith. More specifically, flow control screen assemblies 28*j*, 28*k*, 28*l*, 28*m*, 28*n*, 280 in production interval 26*d* include autonomous inflow control devices. Bypass screen assemblies 30*d*, 30*e* in production interval 26*e* includes bypass valves. Flow control screen assemblies 28*p*, 28*q*, 28*r* in production interval 26*f* include autonomous inflow control devices and bypass screen assembly 30*f* in production interval 26*f* includes a bypass valve.

Production interval 26*d* is defined as the production zone of formation 50 between a pair of annular barriers depicted as packers 32*e*, 32*f* that provide a fluid seal between completion string 54 and wellbore 52. Similarly, production interval 26*e* is defined as the production zone of formation 50 between a pair of annular barriers depicted as packers 32*f*, 32*g* that provide a fluid seal between completion string 54 and wellbore 52. In addition, production interval 26*f* is defined as the production zone of formation 50 between the toe of wellbore 52 and an annular barrier depicted as packer 32*h* that provides a fluid seal between completion string 54 and wellbore 52. In the illustrated embodiment, flow control screen assemblies 28 serve to filter particulate matter out of the production fluid stream when the autonomous inflow control devices of completion string 54 are controlling the inflow of production fluids responsive to a fluid property of the formation fluid being produced such as the viscosity and/or density of the formation fluid. Similarly, bypass screen assemblies 30 serve to filter particulate matter out of the production fluid stream when the bypass valves of completion string 54 are allowing bypass flow of the formation fluid around the autonomous inflow control devices of completion string 54. As illustrated, certain production intervals in a well system of the present disclosure may include only flow control screen assemblies 28 with autonomous inflow control devices (see production interval 26*d*). Likewise, certain production intervals in a well system of the present disclosure may include only bypass screen assemblies 30 with bypass valves (see production interval 26*e*). Also, certain production intervals in a well system of the present disclosure may include flow control screen assemblies 28 with autonomous inflow control devices and bypass screen assemblies 30 with bypass valves (see production interval 26*f*). Accordingly, the exact design of the well system including the number and locations of flow control screen assemblies 28 and bypass screen assemblies 30 will be determined based upon factors that are known to those skilled in the art including the reservoir pressure, the expected composition of the production fluid, the expected production rate and the like.

Figure 2A:
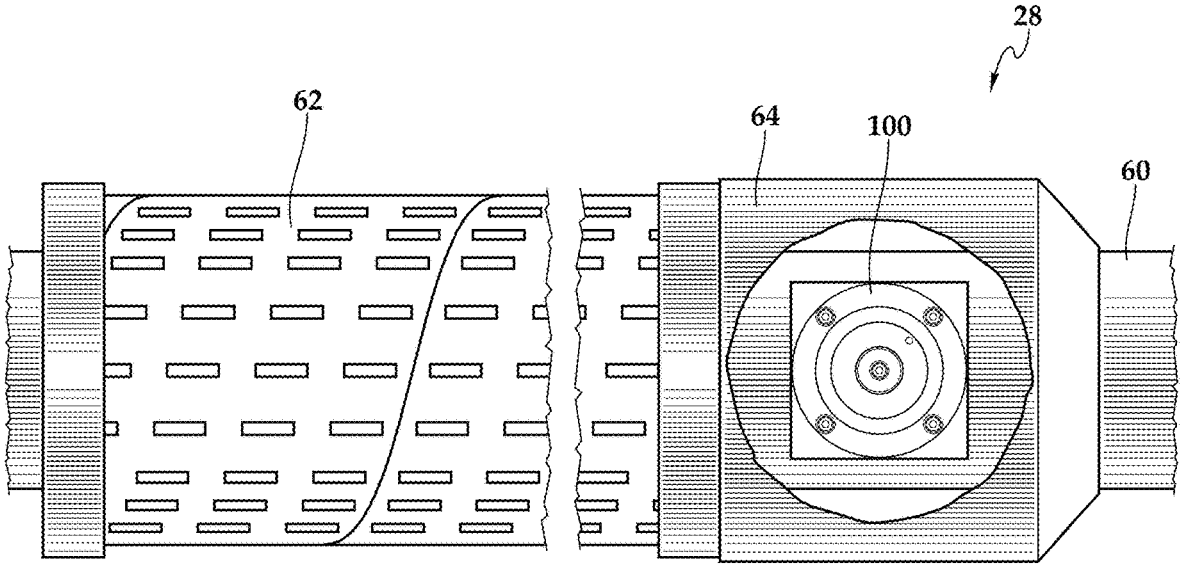
FIG. 2A is a top view of a flow control screen assembly including one or more autonomous inflow control devices according to embodiments of the present disclosure.

Referring next to FIG. 2A, therein is depicted a flow control screen assembly according to the present disclosure that is representatively illustrated and generally designated 28. Flow control screen assembly 28 may be suitably coupled to other screen assemblies, production packers, locating nipples, production tubulars or other downhole tools to form a completions string as described above. Flow control screen assembly 28 includes a base pipe 60 that preferably has a blank pipe section disposed to the interior of a screen element or filter medium 62, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those having ordinary skill in the art that the embodiments of the present disclosure need not have a filter medium associated therewith, accordingly, the exact design of the filter medium is not critical to the present disclosure.

Fluid produced through filter medium 62 travels toward and enters an annular area between outer housing 64 and base pipe 60. To enter the interior of base pipe 60, the fluid must pass through an autonomous inflow control device 100 that is seen through the cutaway section of outer housing 64. Autonomous inflow control device 100 may be threadably coupled to or otherwise secured to base pipe 60 such that one or more outlets of autonomous inflow control device 100 are in fluid communication with the interior of base pipe 60. It should be understood by those having ordinary skill in the art that each flow control screen assembly 28 may include one or more autonomous inflow control devices 100. For example, autonomous inflow control devices 100 may be circumferentially distributed about base pipe 60 such as at 180 degree intervals, 120 degree intervals, 90 degree intervals or other suitable distribution. Alternatively or additionally, autonomous inflow control devices 100 may be longitudinally distributed along base pipe 60. Regardless of the exact configuration of autonomous inflow control devices 100 on base pipe 60, any desired number of autonomous inflow control devices 100 may be incorporated into a flow control screen assembly 28, with the exact configuration depending upon factors that are known to those skilled in the art including the reservoir pressure, the expected composition of the production fluid, the expected production rate and the like. The various connections of the components of flow control screen assembly 28 may be made in any suitable fashion including welding, threading and the like as well as through the use of fasteners such as pins, set screws and the like. Even though autonomous inflow control devices 100 has been described and depicted as being coupled to the exterior of base pipe 60, it will be understood by those skilled in the art that the autonomous inflow control devices of the present disclosure may be alternatively positioned such as to the interior of the base pipe so long as the autonomous inflow control devices are positioned between the upstream or formation side and the downstream or base pipe interior side of the formation fluid path.

Autonomous inflow control devices 100 may be operable to control the flow of fluid in both the production direction and the injection direction therethrough. For example, during the production phase of well operations, fluid flows from the formation into the production tubing through flow control screen assembly 28. The production fluid, after being filtered by filter medium 62, if present, flows into the annulus between base pipe 60 and outer housing 64. The fluid then enters one or more inlets of autonomous inflow control devices 100 where the desired flow operation occurs depending upon the viscosity and/or the density of the produced fluid. For example, if a desired fluid such as oil is produced, flow through a main flow pathway of autonomous inflow control devices 100 is allowed. If an undesired fluid such as water is produced, flow through the main flow pathway of autonomous inflow control devices 100 is restricted or prevented. In the case of producing a desired fluid, the fluid is discharged through autonomous inflow control devices 100 to the interior flow path of base pipe 60 for production to the surface. As another example, during the treatment phase of well operations, a treatment fluid may be pumped downhole from the surface in the interior flow path of base pipe 60. In this case, the treatment fluid then enters autonomous inflow control devices 100 where the desired flow control operation occurs including opening the main flow pathway. The fluid then travels into the annulus between base pipe 60 and outer housing 64 before injection into the surrounding formation.

Figure 2B:
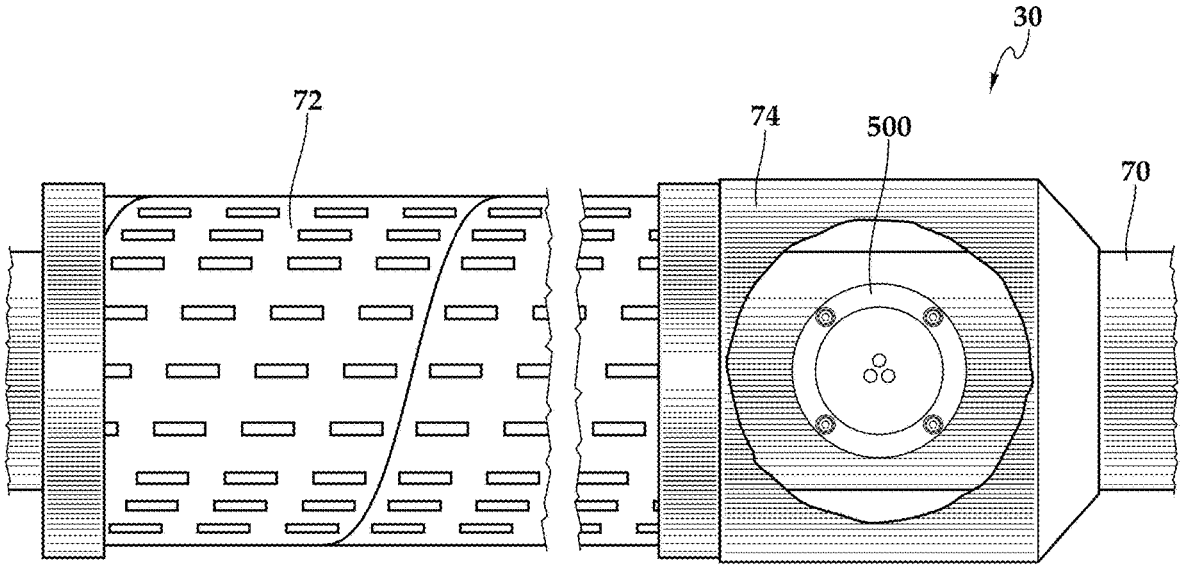
FIG. 2B is a top view of a bypass screen assembly including one or more bypass valves according to embodiments of the present disclosure.
Figure 2C:
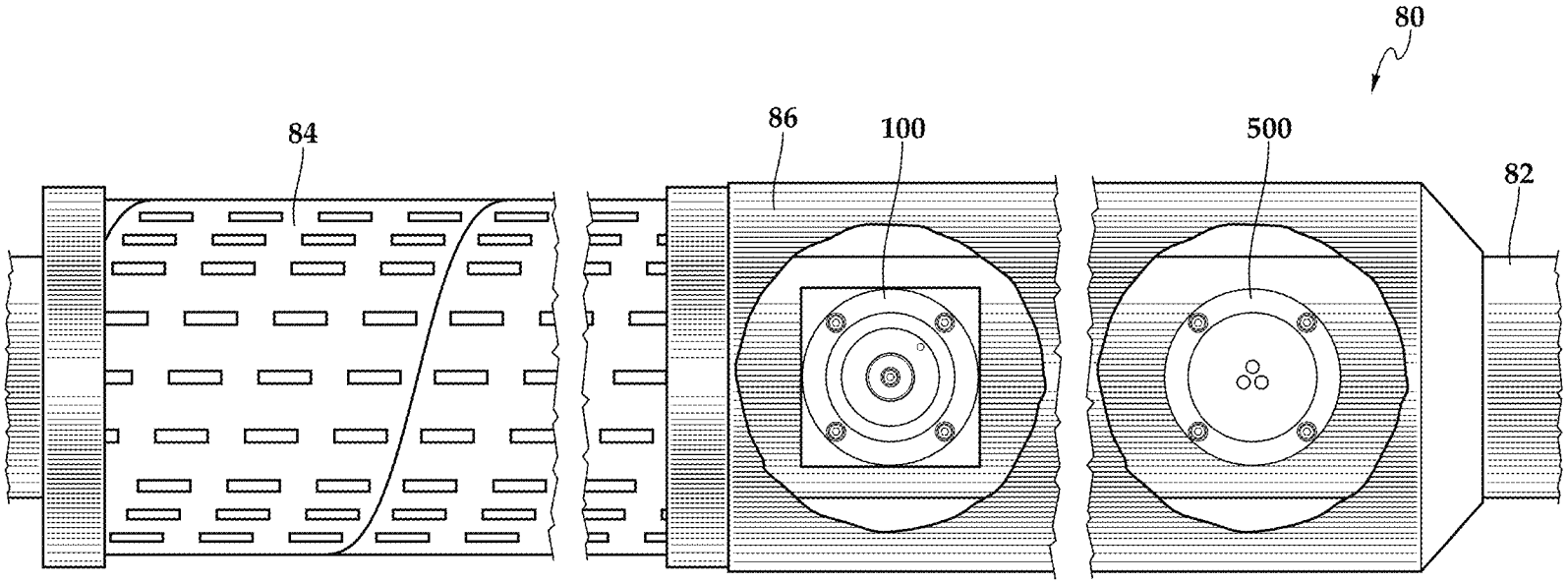
FIG. 2C is a top view of a screen assembly including one or more autonomous inflow control devices and one or more bypass valves according to embodiments of the present disclosure.

Referring next to FIG. 2B, therein is depicted a bypass screen assembly according to the present disclosure that is representatively illustrated and generally designated 30. Bypass screen assembly 30 may be suitably coupled to other screen assemblies, production packers, locating nipples, production tubulars or other downhole tools to form a completions string as described above. Bypass screen assembly 30 includes a base pipe 70 that preferably has a blank pipe section disposed to the interior of a screen element or filter medium 72, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those having ordinary skill in the art that the embodiments of the present disclosure need not have a filter medium associated therewith, accordingly, the exact design of the filter medium is not critical to the present disclosure.

Fluid produced through filter medium 72 travels toward and enters an annular area between outer housing 74 and base pipe 70. To enter the interior of base pipe 70, the fluid must pass through a bypass valve 500 that is seen through a cutaway section of outer housing 74. Bypass valve 500 is threadably coupled to or otherwise secured to base pipe 70 such that one or more outlets of bypass valve 500 are in fluid communication with the interior of base pipe 70. It should be understood by those having ordinary skill in the art that each bypass screen assembly 30 may include one or more bypass valves 500. For example, bypass valves 500 may be circumferentially and/or longitudinally distributed along base pipe 70. Regardless of the exact configuration of bypass valves 500 on base pipe 70, any desired number of bypass valves 500 may be incorporated into a bypass screen assembly 30, with the exact configuration depending upon factors that are known to those skilled in the art including the reservoir pressure, the expected composition of the production fluid, the expected production rate and the like. The various connections of the components of bypass screen assembly 30 may be made in any suitable fashion including welding, threading and the like as well as through the use of fasteners such as pins, set screws and the like. Even though bypass valves 500 has been described and depicted as being coupled to the exterior of base pipe 70, it will be understood by those skilled in the art that the bypass valves of the present disclosure may be alternatively positioned such as to the interior of the base pipe so long as the bypass valves are positioned between the upstream and the downstream sides of the formation fluid path.

Even though FIGS. 1A-2B have depicted and described certain screen assemblies as having one or more autonomous inflow control devices and certain screen assemblies as having one or more bypass valves, it should be understood by those having ordinary skill in the art that a screen assembly of the present disclosure could incorporate one or more autonomous inflow control devices as well as one or more bypass valves without departing from the principles of the present disclosure. For example, as best seen in FIG. 2C, therein is depicted a screen assembly according to the present disclosure that is representatively illustrated and generally designated 80. Screen assembly 80 may be suitably coupled to other screen assemblies, production packers, locating nipples, production tubulars or other downhole tools to form a completions string as described above. Screen assembly 80 includes a base pipe 82 that preferably has a blank pipe section disposed to the interior of a screen element or filter medium 84. During the initial phase of production operations, fluid produced through filter medium 84 travels toward and enters the annular area between outer housing 86 and base pipe 82 then passes through autonomous inflow control device 100 that is seen through a cutaway section of outer housing 86. In later stages of production when the autonomous inflow control devices are choking high water cut production along the length of the well and the bypass valves have been opened, fluid produced through filter medium 84 travels toward and enters the annular area between outer housing 86 and base pipe 82 then passes through bypass valve 500 that is seen through a cutaway section of outer housing 86. As such, screen assembly 80 operates as either a flow control screen assembly 28 or a bypass screen assembly 30 depending upon the phase of well operations and would be considered a flow control tubular and/or a bypass tubular as claimed herein.

Figure 3A:
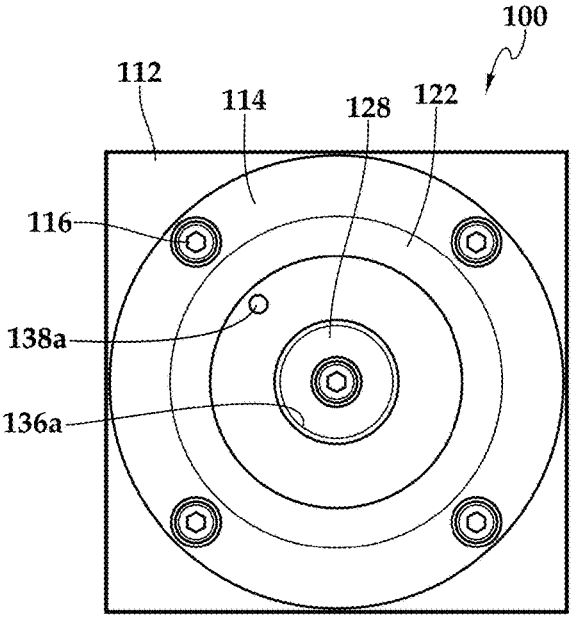
FIGS. 3A-3D are various views of an autonomous inflow control device according to embodiments of the present disclosure.
Figure 3B:
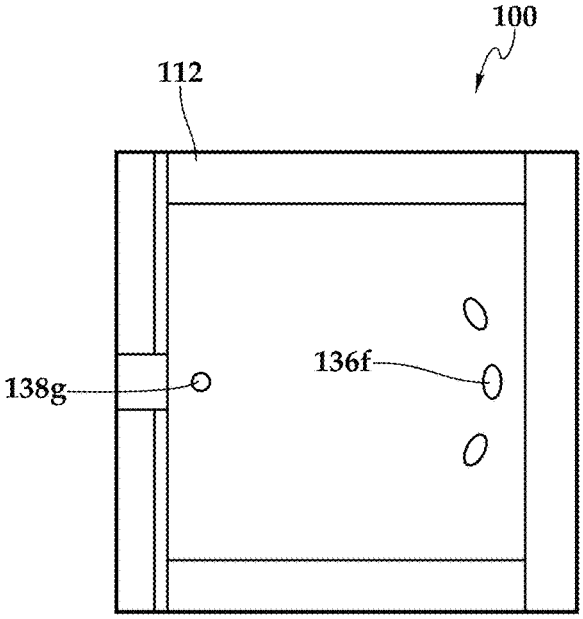
Figure 3C:
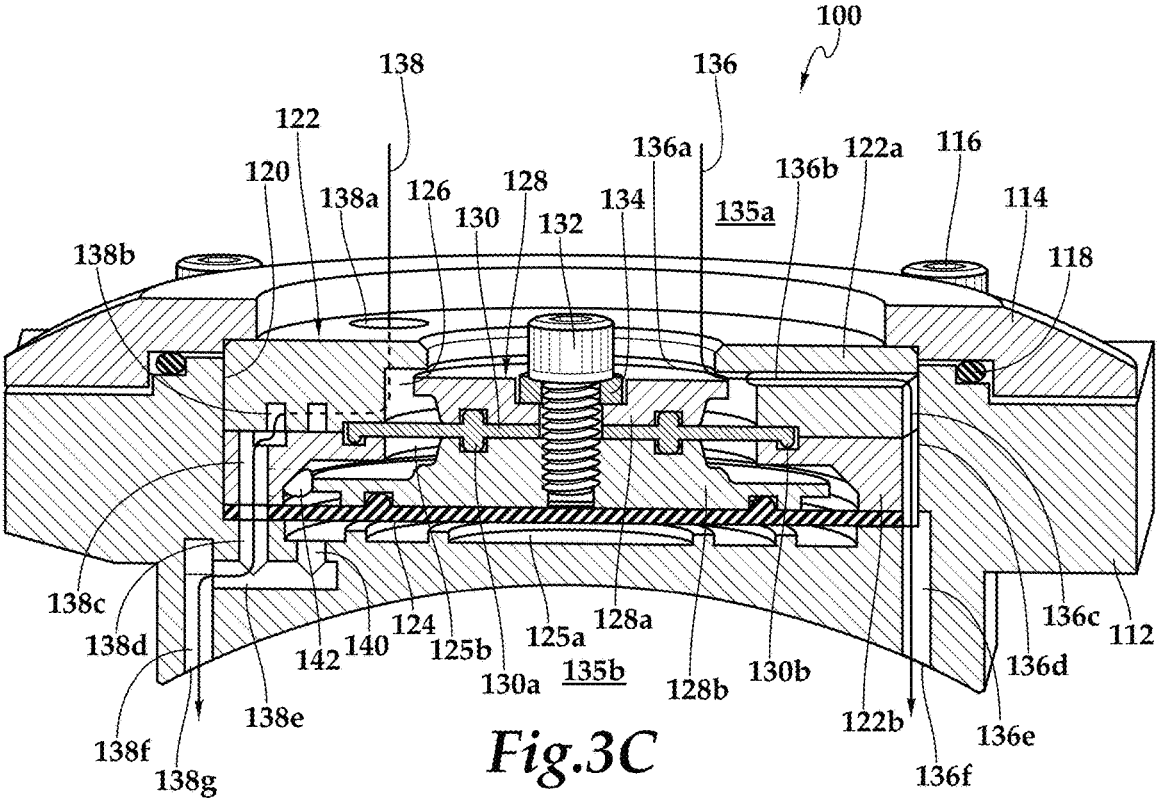
Figure 3D:
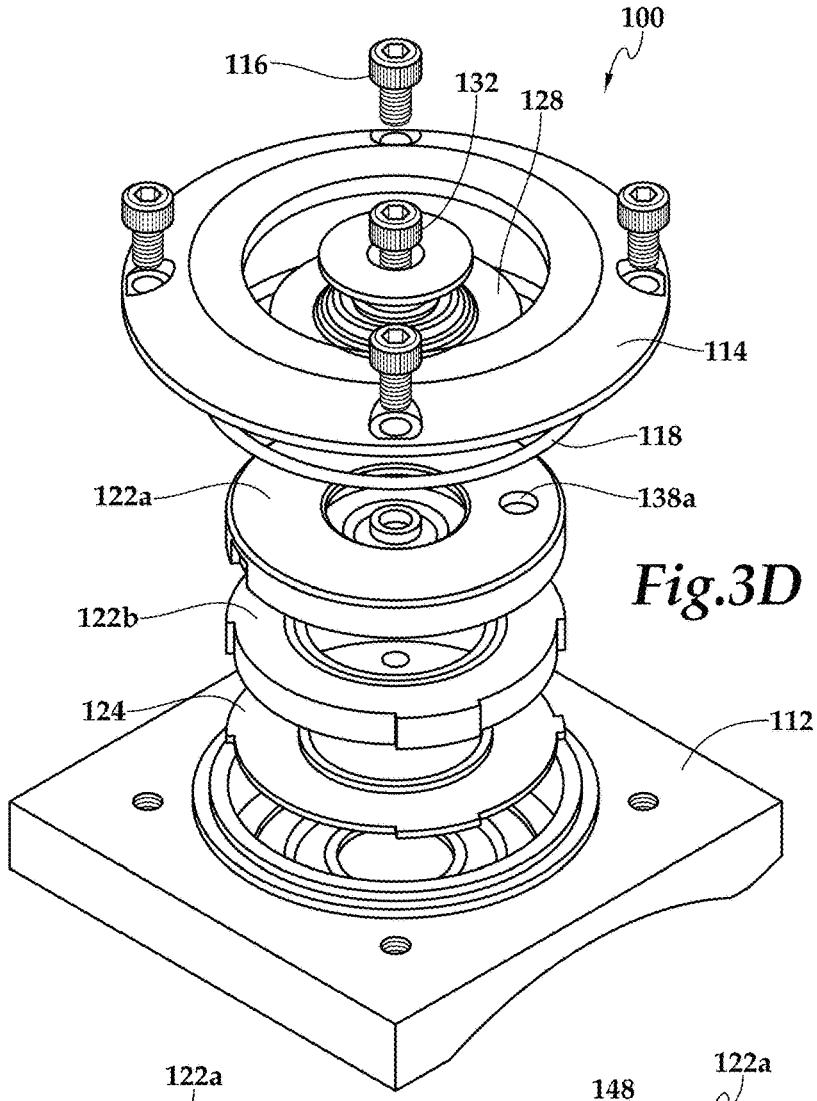

Referring next to FIGS. 3A-3D, an autonomous inflow control device for use in a downhole fluid flow control system of the present disclosure is representatively illustrated and generally designated 100. Autonomous inflow control device 100 includes a housing member 112 and a housing cap 114 that are coupled together with a plurality of bolts 116. An O-ring seal 118 is disposed between housing member 112 and housing cap 114 to provide a fluid seal therebetween. Housing member 112 and housing cap 114 may collectively be referred to as the housing of autonomous inflow control device 100. As best seen in FIG. 3C, housing member 112 defines a generally cylindrical cavity 120. In the illustrated embodiment, a viscosity discriminator disk 122 is closely received within cavity 120. Viscosity discriminator disk 122 includes an upper viscosity discriminator plate 122*a* and a lower viscosity discriminator plate 122*b*. A generally cylindrical seal element 124 is disposed between a lower surface of lower viscosity discriminator plate 122*b* and a lower chamber 125*a* of housing member 112.

As best seen in FIG. 3C, viscosity discriminator disk 122 defines a generally cylindrical cavity 126 having a contoured and stepped profile. In the illustrated embodiment, a valve element 128 is received within cavity 126. Valve element 128 includes an upper valve plate 128*a* and a lower valve plate 128*b*. A generally cylindrical seal element 130 is disposed between upper valve plate 128*a* and lower valve plate 128*b*. In addition, a radially outer portion of seal element 130 is disposed between upper viscosity discriminator plate 122*a* and lower viscosity discriminator plate 122*b*. In the illustrated embodiment, an inner ring 130*a* of seal element 130 is received within glands of upper valve plate 128*a* and lower valve plate 128*b*. An outer ring 130*b* of seal element 130 is received within a gland of lower viscosity discriminator plate 122*b*. Upper valve plate 128*a*, lower valve plate 128*b* and seal element 130 are coupled together with a bolt 132 and washer 134 such that upper valve plate 128*a* and lower valve plate 128*b* act as a single valve element 128.

Autonomous inflow control device 100 includes a main fluid pathway extending between an upstream side 135*a* and a downstream side of 135*b* of autonomous inflow control device 100 illustrated along streamline 136 in FIG. 3C. In the illustrated embodiment, main fluid pathway 136 includes an inlet 136*a* between a lower surface of upper viscosity discriminator plate 122*a* and an upper surface of valve element 128. Main fluid pathway 136 also includes three radial pathways 136*b* (only one being visible in FIG. 3C) that extend through upper viscosity discriminator plate 122*a*, three longitudinal pathways 136*c* (only one being visible in FIG. 3C) that extend through upper viscosity discriminator plate 122*a*, three longitudinal pathways 136*d* (only one being visible in FIG. 3C) that extend through lower viscosity discriminator plate 122*b* and three longitudinal pathways 136*e* (only one being visible in FIG. 3C) that extend through housing member 112. As best seen in FIG. 3B, main fluid pathway 136 includes three outlets 136*f*. Even though main fluid pathway 136 has been depicted and described as having a particular configuration with a particular number of pathways, it should be understood by those skilled in the art that a main fluid pathway of the present disclosure may have a variety of designs with any number of pathways, branches and/or outlets both greater than or less than three as long as the main fluid pathway provides a fluid path between the upstream and downstream sides of the fluid control module.

Autonomous inflow control device 100 includes a secondary fluid pathway extending between upstream side 135*a* and downstream side of 135*b* of autonomous inflow control device 100 illustrated as streamline 138 in FIG. 3C. In the illustrated embodiment, secondary fluid pathway 138 includes an inlet 138*a* in upper viscosity discriminator plate 122*a*. Secondary fluid pathway 138 also includes a viscosity sensitive channel 138*b* that extends through upper viscosity discriminator plate 122*a*, a longitudinal pathway 138*c* that extends through lower viscosity discriminator plate 122*b*, a longitudinal pathway 138*d* that extend through housing member 112, a radial pathway 138*e* that extend through housing member 112 and a longitudinal pathway 138*f* that extend through housing member 112. As best seen in FIG. 3B, secondary fluid pathway 138 includes an outlet 138*g*. Secondary fluid pathway 138 is in fluid communication with lower chamber 125*a* via a pressure port 140 that is in fluid communication with radial pathway 138*e*. In the illustrated embodiment, pressure port 140 intersect secondary fluid pathway 138 at a location downstream of viscosity sensitive channel 138*b*. In other embodiments, pressure port 140 could intersect secondary fluid pathway 138 at a location upstream of viscosity sensitive channel 138*b* or other suitable location along secondary fluid pathway 138. Autonomous inflow control device 100 includes a pressure port 142 that extends through lower viscosity discriminator plate 122*b* and housing member 112 to provide fluid communication between downstream side of 135*b* and an upper chamber 125*b* defined between seal element 124 and seal element 130. The fluid flowrate ratio between main fluid pathway 136 and the secondary fluid pathway 138 may be between about 3 to 1 and about 10 to 1 or higher and is preferably greater than 4 to 1 when main fluid pathway 136 is open.

Figure 4A:
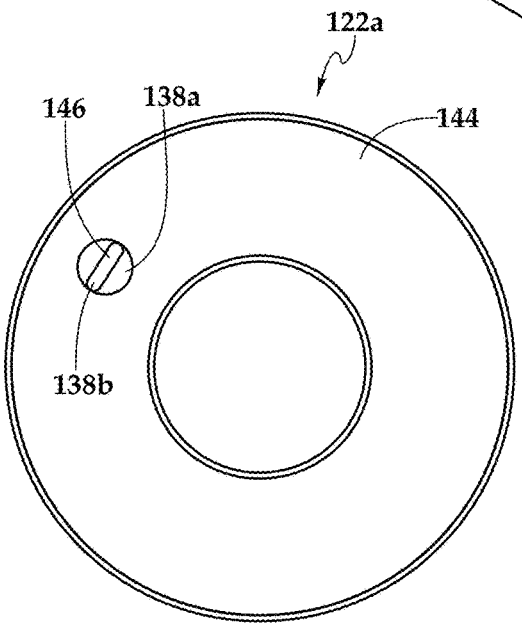
FIGS. 4A-4B are top and bottom views of a viscosity discriminator plate for an autonomous inflow control device according to embodiments of the present disclosure.
Figure 4B:
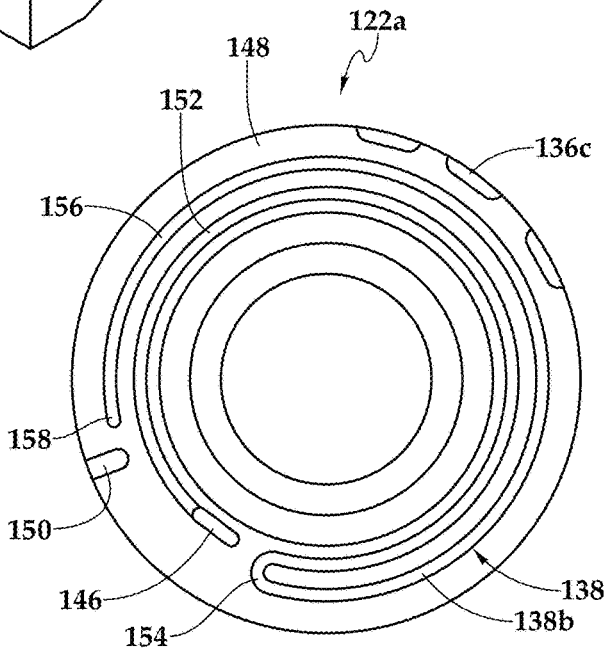

Referring additionally to FIGS. 4A-4B, an exemplary upper viscosity discriminator plate 122*a* of a viscosity discriminator 122 is depicted. As best seen in FIG. 4A, an upper surface 144 of upper viscosity discriminator plate 122*a* includes inlet 138*a* of secondary fluid pathway 138. Inlet 138*a* is aligned with a beginning portion 146 of viscosity sensitive channel 138*b*. As best seen in FIG. 4B, a lower surface 148 of upper viscosity discriminator plate 122*a* includes three longitudinal pathways 136*c* of main fluid pathway 136 and an alignment notch 150 that mates with a lug of lower viscosity discriminator plate 122*b* to assure that upper viscosity discriminator plate 122*a* and lower viscosity discriminator plate 122*b* are properly oriented relative to each other. Lower surface 148 also includes viscosity sensitive channel 138*b* of secondary fluid pathway 138. In the illustrated embodiment, viscosity sensitive channel 138*b* includes beginning portion 146, an inner circumferential path 152, a turn depicted as reversal of direction path 154, an outer circumferential path 156 and an end portion 158. End portion 158 is in fluid communication with longitudinal pathway 138*c* that extends through lower viscosity discriminator plate 122*b*.

Viscosity sensitive channel 138*b* provides a tortuous path for fluids traveling through secondary fluid pathway 138. In addition, viscosity sensitive channel 138*b* preferably has a characteristic dimension that is small enough to make the effect of the viscosity of the fluid flowing therethrough non-negligible. When a low viscosity fluid such as water is being produced, the flow through viscosity sensitive channel 138*b* may be turbulent having a Reynolds number in a range of 10,000 to 100,000 or higher. When a high viscosity fluid such as oil is being produced, the flow through viscosity sensitive channel 138*b* may be less turbulent or even laminar having a Reynolds number in a range of 1,000 to 10,000.

Even through upper viscosity discriminator plate 122*a* has been depicted and described as having a particular shape with a viscosity sensitive channel having a tortuous path with a particular orientation, it should be understood by those having skill in the art that an upper viscosity discriminator plate of the present disclosure could have a variety of shapes and could have a tortuous path with a variety of different orientations. In addition, even though viscosity discriminator 122 has been depicted and described as having upper and lower viscosity discriminator plates, it should be understood by those having skill in the art that a viscosity discriminator of the present disclosure may have other numbers of plates both less than and greater than two. Further, even though viscosity sensitive channel 138*b* has been depicted and described as being on a surface of a viscosity discriminator plate, it should be understood by those having skill in the art that a viscosity sensitive channel could alternatively be formed within a viscosity discriminator, such as a viscosity discriminator formed from a signal component.

Figure 5A:
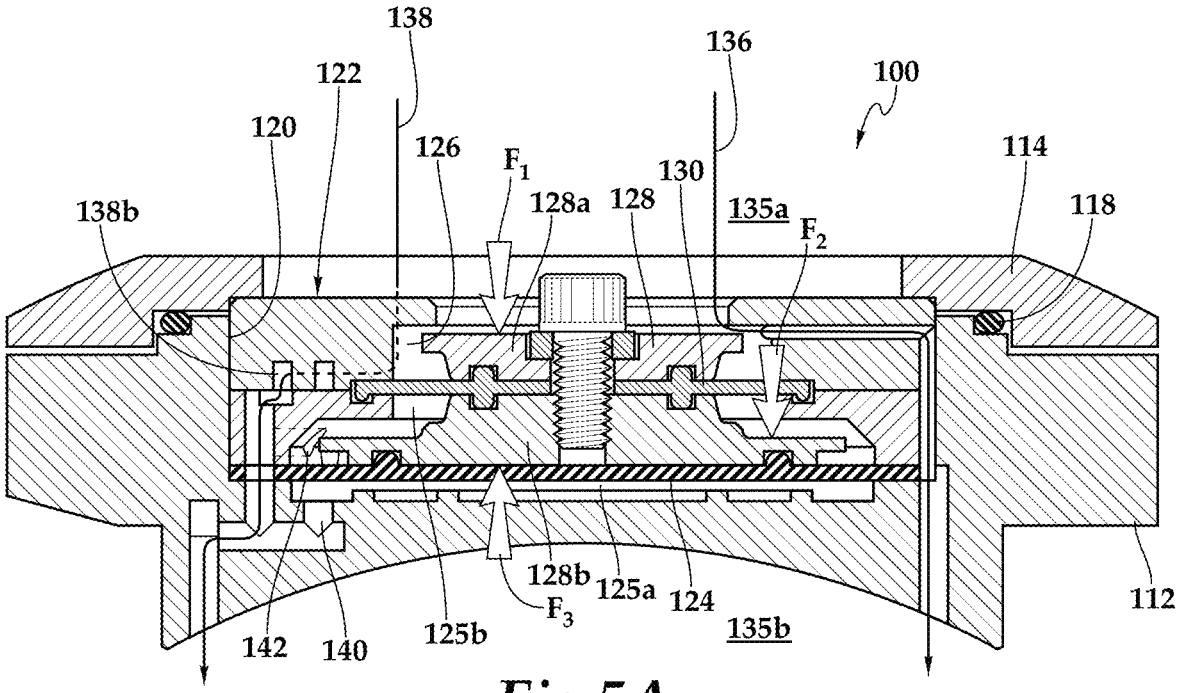
FIGS. 5A-5B are cross sectional views of an autonomous inflow control device in an open position and a closed position, respectively, according to embodiments of the present disclosure.
Figure 5B:
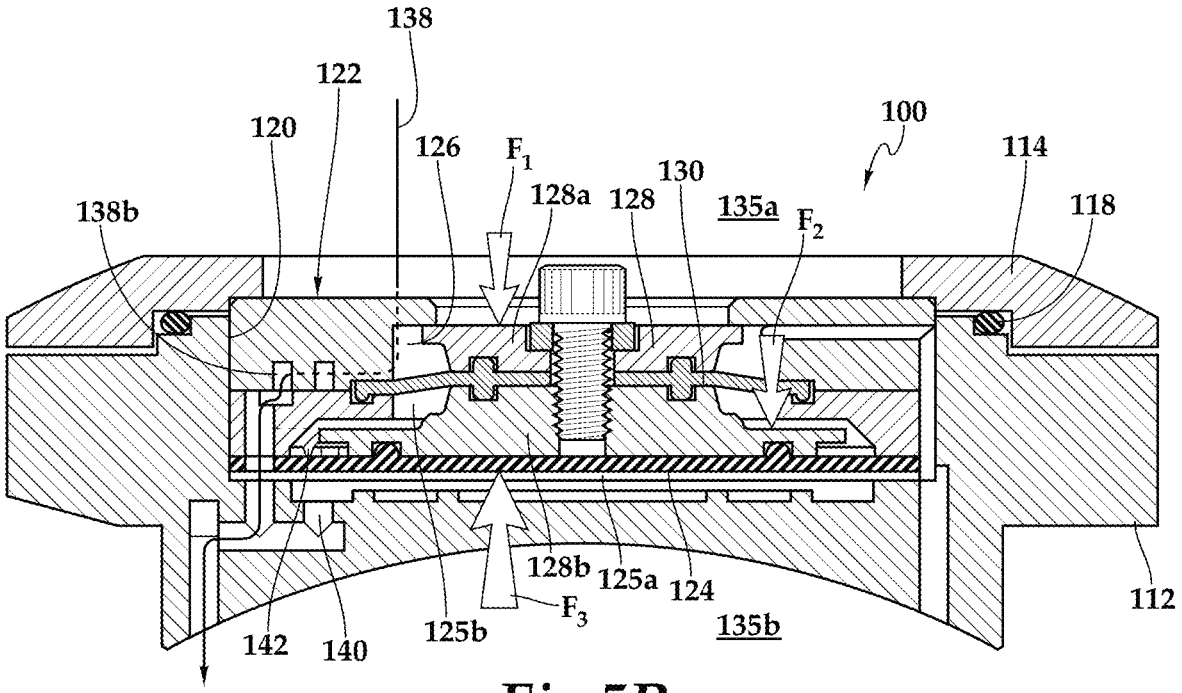

Referring next to FIGS. 5A-5B, an autonomous inflow control device in its open and closed positions is representatively illustrated and generally designated 100. Autonomous inflow control device 100 has a housing member 112 and a housing cap 114 that are coupled together with a plurality of bolts (see FIG. 3C) with a seal element 118 therebetween. A viscosity discriminator 122 and a seal element 124 are disposed within a cavity 120 of housing member 112. A valve element 128 and a seal element 130 are disposed within a cavity 126 of viscosity discriminator 122. Autonomous inflow control device 100 defines a main fluid pathway 136 and a secondary fluid pathway 138 each extending between upstream side 135*a* and downstream side 135*b* of autonomous inflow control device 100. Viscosity discriminator 122 includes a viscosity sensitive channel 138*b* that forms a portion of secondary fluid pathway 138. In addition, viscosity discriminator 122 and housing member 112 form a pressure port 142 that provides fluid communication from downstream side 135*b* to an upper chamber 125*b*. A pressure port 140 in housing member 112 provides fluid communication from secondary fluid pathway 138 to lower chamber 125*a*.

As can be seen by comparing FIGS. 5A and 5B, valve element 128 is operable for movement within autonomous inflow control device 100 and is depicted in its fully open position in FIG. 5A and its fully closed position in FIG. 5B. It should be noted by those skilled in the art that valve element 128 also has a plurality of choking positions between the fully open and fully closed positions. Valve element 128 is operated between the open and closed positions responsive to a differential pressure switch. The differential pressure switch includes a pressure signal $P_1$ from upstream side 135*a* acting on an upper surface $A_1$ of upper valve plate 128*a* to generate a force $F_1$ that biases valve element 128 toward the open position. The differential pressure switch also includes a pressure signal $P_2$ from downstream side 135*b* via pressure port 142 acting on an upper surface $A_2$ of lower valve plate 128*b* to generate a force $F_2$ that biases valve element 128 toward the open position. In addition, the differential pressure switch includes a pressure signal $P_3$ from secondary fluid pathway 138 via pressure port 140 acting on a lower surface $A_3$ of valve element 128 to generate a force $F_3$ that biases valve element 128 toward the closed position.

As best seen in FIG. 5A, when $(P_1A_1)+(P_2A_2)>(P_3A_3)$ or $F_1+F_2>F_3$, valve element 128 is biased to the open position. This figure may represent a production scenario when a desired fluid having a high viscosity such as oil is being produced. As best seen in FIG. 5B, when $(P_1A_1)+(P_2A_2)<(P_3A_3)$ or $F_1+F_2<F_3$, valve element 128 is biased to the closed position. This figure may represent a production scenario when an undesired fluid having a low viscosity such as water is being produced. The differential pressure switch operates responsive to changes in the magnitude of the pressure signal $P_3$ from secondary fluid pathway 138 which determines the magnitude of $F_3$. The magnitude of pressure signal $P_3$ is established based upon the viscosity of the fluid traveling through secondary fluid pathway 138. More specifically, the tortuous path created by viscosity sensitive channel 138*b* has a different influence on high viscosity fluids, such as oil, compared to low viscosity fluids, such as water. For example, the tortuous path will have a greater influence relative to the velocity of high viscosity fluids traveling therethrough compared to the velocity of low viscosity fluids traveling therethrough, which results in a greater reduction in the dynamic pressure $P_D$ of high viscosity fluids compared to low viscosity fluids traveling through viscosity sensitive channel 138*b*. In this manner, using the fluid flow control system of the present disclosure having a viscosity dependent differential pressure switch enables autonomous operation of the valve element as the viscosity of a production fluid changes over the life of a well to enable production of a desired fluid, such as oil, though the main flow pathway while restricting or shutting off the production of an undesired fluid, such as water or gas, though the main flow pathway.

Figure 6A:
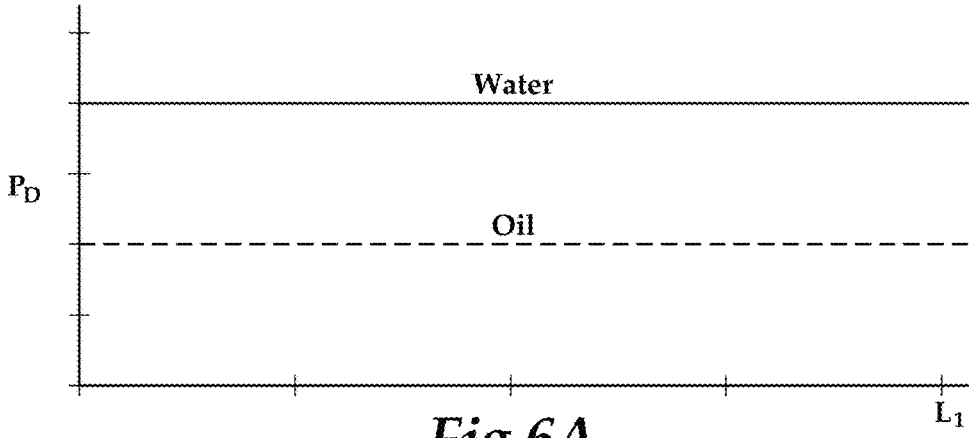
FIGS. 6A-6C are pressure versus distance graphs depicting the influence of a viscosity sensitive channel on fluids traveling therethrough according to embodiments of the present disclosure.
Figure 6B:
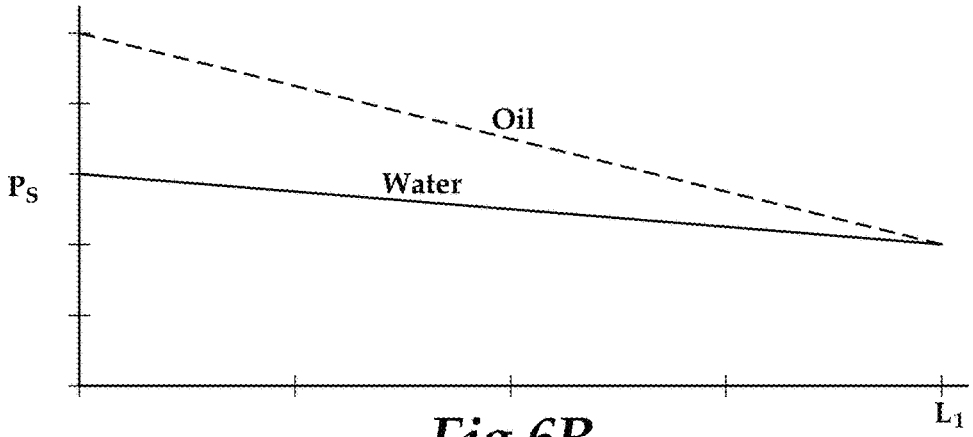
Figure 6C:
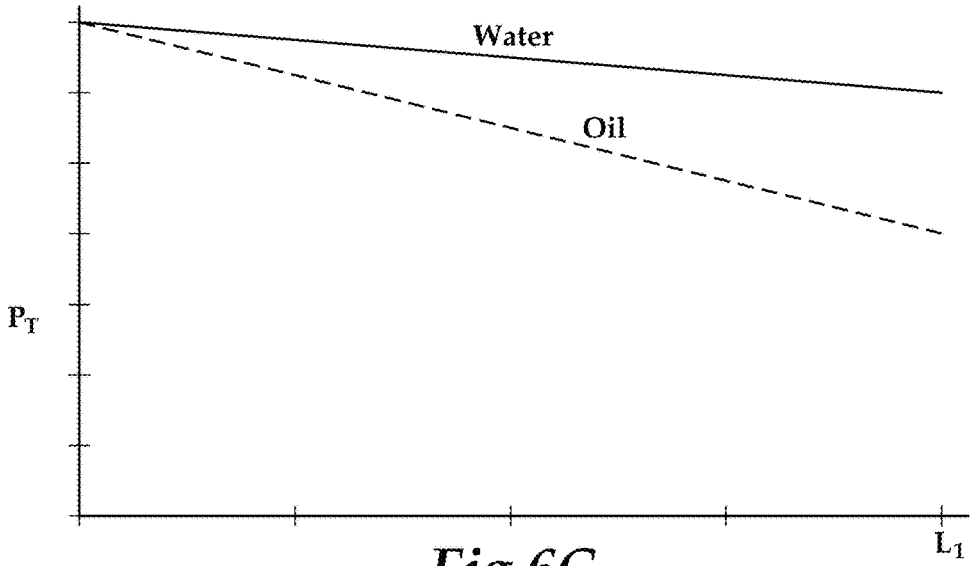

According to Bernoulli's principle, the sum of the static pressure $P_S$, the dynamic pressure $P_D$ and a gravitation term is a constant and is referred to herein as the total pressure $P_T$. In the present case, the gravitational term is negligible due to low elevation change. FIG. 6A is a pressure versus distance graph illustrating the influence of the tortuous path on the dynamic pressure $P_D$ of a high viscosity fluid compared to a low viscosity fluid traveling through viscosity sensitive channel 138*b*. FIG. 6B is a pressure versus distance graph illustrating the influence of the tortuous path on the static pressure $P_S$ of a high viscosity fluid compared to a low viscosity fluid traveling through viscosity sensitive channel 138*b*. FIG. 6C is a pressure versus distance graph illustrating the influence of the tortuous path on the total pressure $P_T$ of a high viscosity fluid compared to a low viscosity fluid traveling through viscosity sensitive channel 138*b*. In the graphs, it is assumed that in both the high viscosity fluid and the low viscosity fluid cases, the pressure at upstream side 135*a* is constant and the pressure at downstream side 135*b* is constant. As best seen in FIG. 6C, the total pressure $P_T$ of the high viscosity fluid proximate a downstream location of viscosity sensitive channel 138*b* is less than the total pressure $P_T$ of the low viscosity fluid at the same location, such as location $L_1$ in the graph. Thus, the magnitude of pressure signal $P_3$ taken at a location downstream of viscosity sensitive channel 138*b* for a high viscosity fluid will be less than the magnitude of pressure signal $P_3$ taken at the same location for a low viscosity fluid. This difference in magnitude of pressure signal $P_3$ is sufficient to trigger the differential pressure switch to shift valve element 128 between the open position when a high viscosity fluid, such as oil, is flowing and the closed position when low viscosity fluid, such as water, is flowing.

Figure 7A:
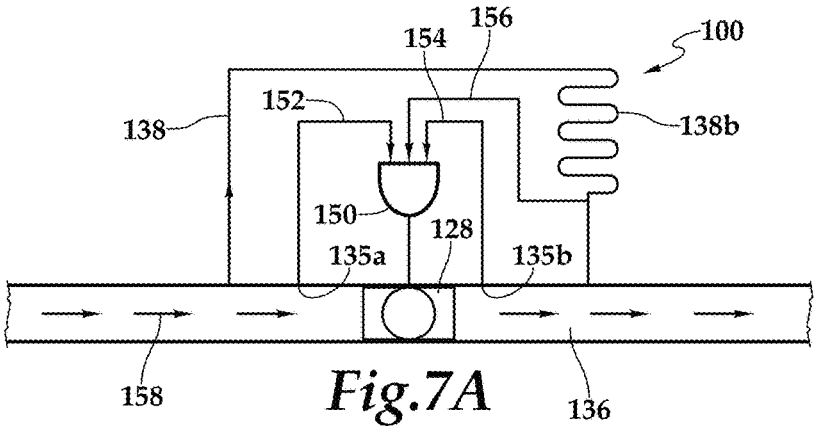
FIGS. 7A-7B are schematic illustrations of an autonomous inflow control device according to embodiments of the present disclosure.
Figure 7B:
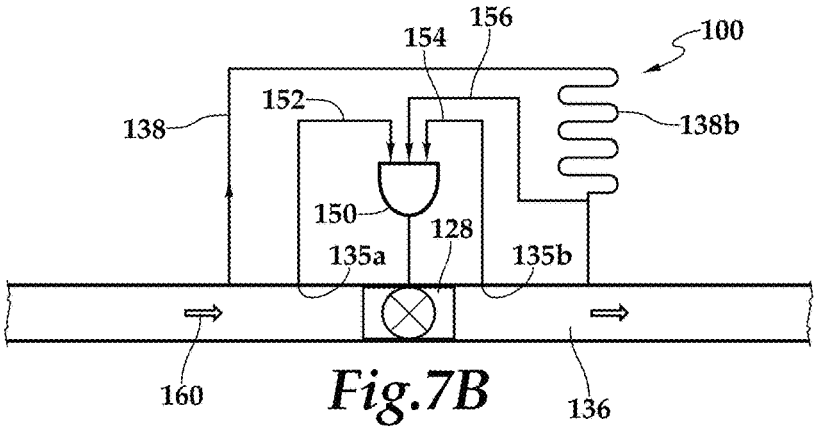

Referring next to FIGS. 7A-7B, an autonomous inflow control device 100 is represented as a circuit diagram. Autonomous inflow control device 100 includes main fluid pathway 136 having a valve element 128 disposed therein. Autonomous inflow control device 100 also includes secondary fluid pathway 138 having viscosity sensitive channel 138*b*. Autonomous inflow control device 100 further includes a differential pressure switch 150 including a pressure signal 152 from upstream side 135*a* biasing valve element 128 to the open position, a pressure signal 154 from downstream side 135*b* biasing valve element 128 to the open position and a pressure signal 156 from secondary fluid pathway 138 biasing valve element 128 to the closed position.

In FIG. 7A, a high viscosity fluid, such as oil, is being produced through autonomous inflow control device 100 and is represented by solid arrows 158. As discussed herein, viscosity sensitive channel 138*b* has a large influence on the velocity of a high viscosity fluid flowing therethrough such that the magnitude of pressure signal 156 will cause differential pressure switch 150 to operate valve element 128 to the open position, as indicated by the high volume of arrows 158 passing through autonomous inflow control device 100. In FIG. 7B, a low viscosity fluid, such as water, is being produced through autonomous inflow control device 100 and is represented by hollow arrows 160. As discussed herein, viscosity sensitive channel 138*b* has a small influence on the velocity of a low viscosity fluid flowing therethrough such that the magnitude of pressure signal 156 will cause differential pressure switch 150 to operate valve element 128 to the closed position, as indicated by the low volume of arrows 160 passing through autonomous inflow control device 100, which may represent flow passing only through secondary fluid pathway 138. In the illustrated embodiment, pressure signal 156 is a total pressure $P_T$ signal taken at a location downstream of viscosity sensitive channel 138*b*.

Figure 8A:
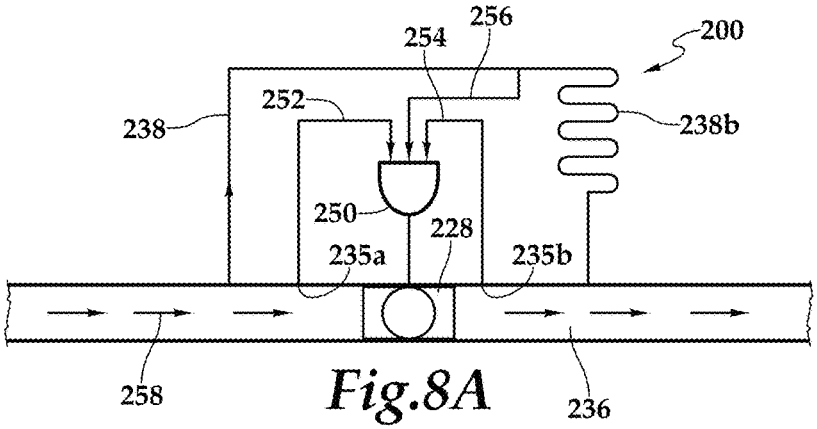
FIGS. 8A-8B are schematic illustrations of an autonomous inflow control device according to embodiments of the present disclosure.
Figure 8B:
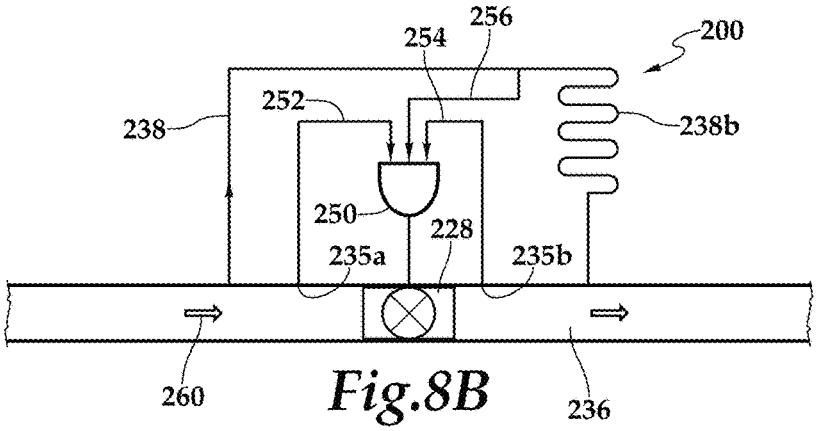

Referring next to FIGS. 8A-8B, an autonomous inflow control device 200 is represented as a circuit diagram. Autonomous inflow control device 200 includes main fluid pathway 236 having a valve element 228 disposed therein. Autonomous inflow control device 200 also includes secondary fluid pathway 238 having viscosity sensitive channel 238*b*. Autonomous inflow control device 200 further includes a differential pressure switch 250 including a pressure signal 252 from upstream side 235*a* biasing valve element 228 to the open position, a pressure signal 254 from downstream side 235*b* biasing valve element 228 to the open position and a pressure signal 256 from secondary fluid pathway 238 biasing valve element 228 to the closed position.

In FIG. 8A, a high viscosity fluid, such as oil, is being produced through autonomous inflow control device 200 and is represented by solid arrows 258. As discussed herein, viscosity sensitive channel 238*b* has a large influence on the velocity of a high viscosity fluid flowing therethrough such that the magnitude of pressure signal 256 will cause differential pressure switch 250 to operate valve element 228 to the open position, as indicated by the high volume of arrows 258 passing through autonomous inflow control device 200. In FIG. 8B, a low viscosity fluid, such as water, is being produced through autonomous inflow control device 200 and is represented by hollow arrows 260. As discussed herein, viscosity sensitive channel 238*b* has a small influence on the velocity of a low viscosity fluid flowing therethrough such that the magnitude of pressure signal 256 will cause differential pressure switch 250 to operate valve element 228 to the closed position, as indicated by the low volume of arrows 260 passing through autonomous inflow control device 200, which may represent flow passing only through secondary fluid pathway 238. In the illustrated embodiment, pressure signal 256 is a static pressure $P_S$ signal taken at a location upstream of viscosity sensitive channel 238*b*.

Figure 9A:
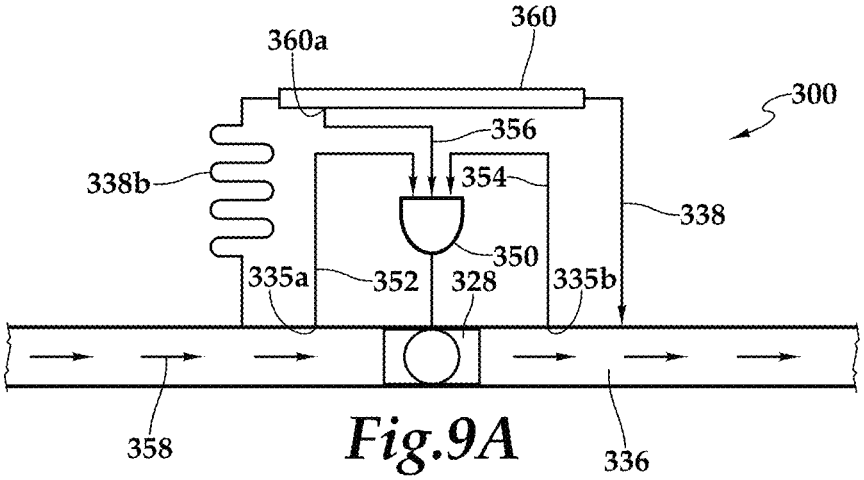
FIGS. 9A-9C are schematic illustrations of an autonomous inflow control device according to embodiments of the present disclosure.
Figure 9B:
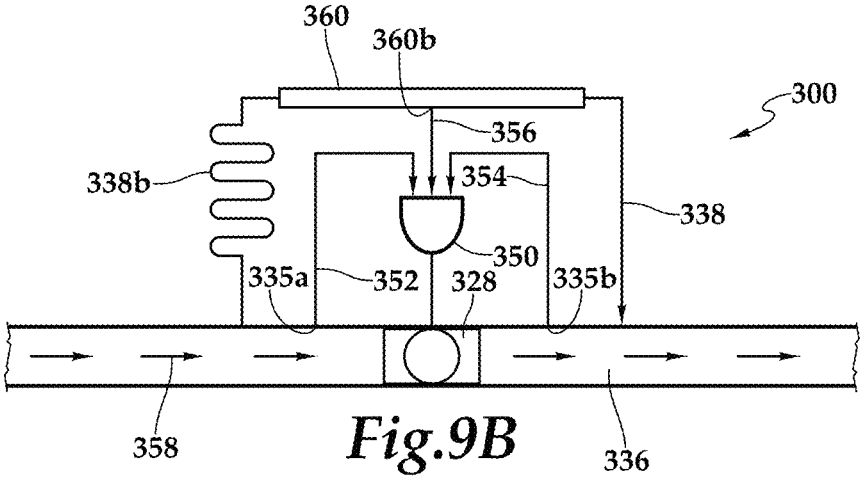
Figure 9C:
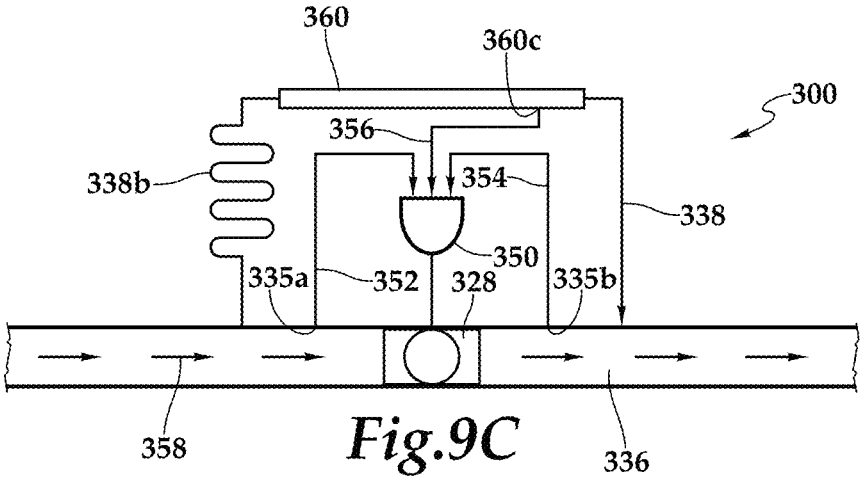

Referring next to FIGS. 9A-9C, an autonomous inflow control device 300 is represented as a circuit diagram. Autonomous inflow control device 300 includes main fluid pathway 336 having a valve element 328 disposed therein. Autonomous inflow control device 300 also includes secondary fluid pathway 338 having viscosity sensitive channel 338*b* and a non viscosity sensitive channel 360. Autonomous inflow control device 300 further includes a differential pressure switch 350 including a pressure signal 352 from upstream side 335*a* biasing valve element 328 to the open position, a pressure signal 354 from downstream side 335*b* biasing valve element 328 to the open position and a pressure signal 356 from secondary fluid pathway 338 biasing valve element 328 to the closed position.

In FIG. 9A, a high viscosity fluid, such as oil, is being produced through autonomous inflow control device 300 and is represented by solid arrows 358. As discussed herein, viscosity sensitive channel 338*b* has a large influence on the velocity of a high viscosity fluid flowing therethrough such that the magnitude of pressure signal 356 will cause differential pressure switch 350 to operate valve element 328 to the open position, as indicated by the high volume of arrows 358 passing through autonomous inflow control device 300. In the illustrated embodiment, pressure signal 356 is a total pressure $P_T$ signal taken downstream of viscosity sensitive channel 338*b* and from an upstream location 360*a* of non viscosity sensitive channel 360. In FIG. 9B, pressure signal 356 is a total pressure $P_T$ signal taken downstream of viscosity sensitive channel 338*b* and from a midstream location 360*b* of non viscosity sensitive channel 360. In FIG. 9C, pressure signal 356 is a total pressure $P_T$ signal taken downstream of viscosity sensitive channel 338*b* and from a downstream location 360*c* of non viscosity sensitive channel 360. Use of the non viscosity sensitive channel 360 in combination with viscosity sensitive channel 338*b* in secondary fluid pathway 338 enables flexibility in the design of autonomous inflow control device 300. Similar to autonomous inflow control devices 100 and 200 described herein, when a low viscosity fluid, such as water, is being produced through autonomous inflow control device 300 viscosity sensitive channel 338*b* has a small influence on the velocity of a low viscosity fluid flowing therethrough such that the magnitude of pressure signal 356 will cause differential pressure switch 350 to operate valve element 328 to the closed position.

Figure 10A:
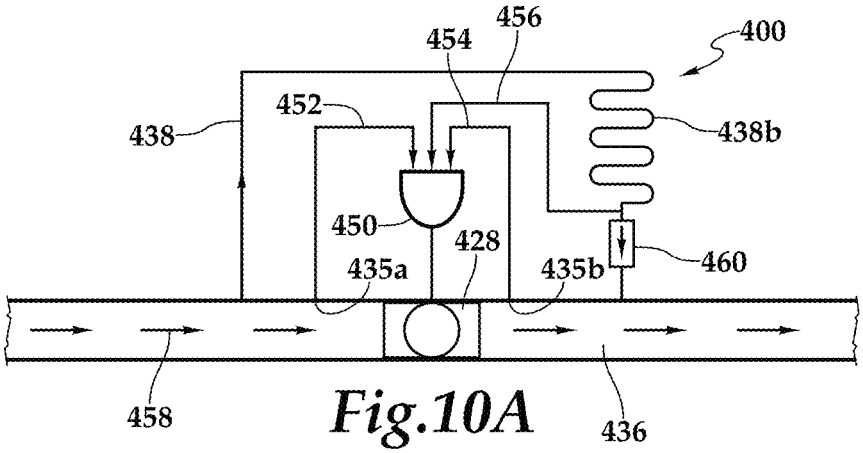
FIGS. 10A-10C are schematic illustrations of an autonomous inflow control device according to embodiments of the present disclosure.
Figure 10B:
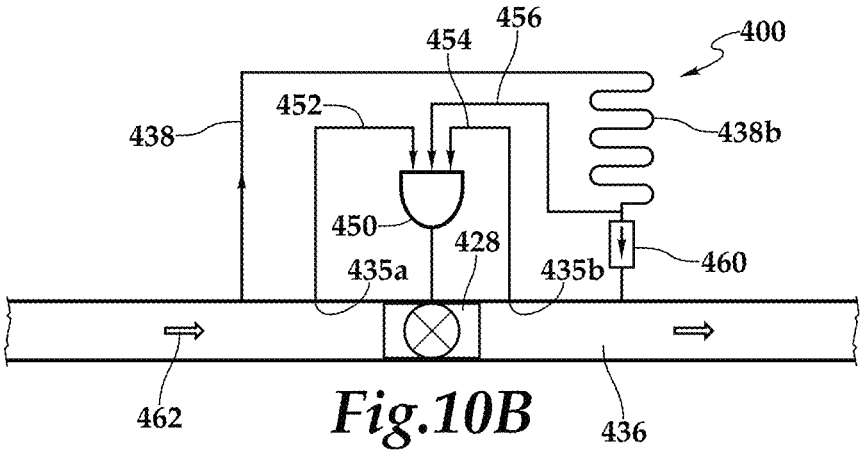
Figure 10C:
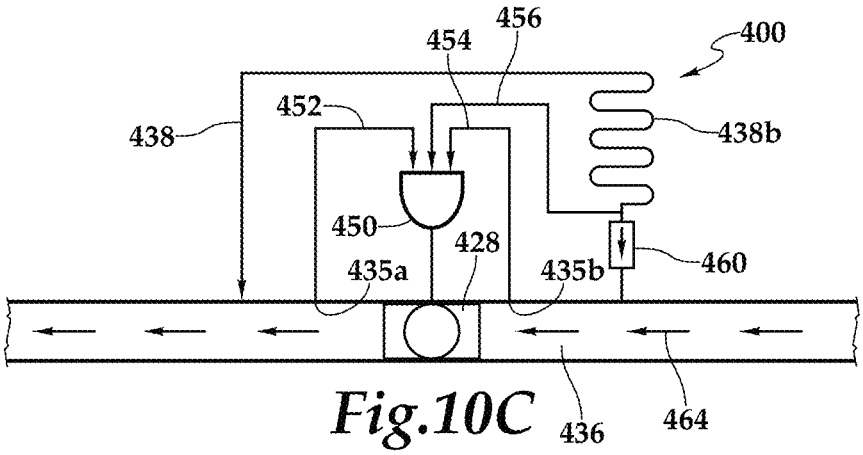

Referring next to FIGS. 10A-10C, an autonomous inflow control device 400 is represented as a circuit diagram. Autonomous inflow control device 400 includes main fluid pathway 436 having a valve element 428 disposed therein. Autonomous inflow control device 400 also includes secondary fluid pathway 438 having viscosity sensitive channel 438*b* and a fluid diode having directional resistance depicted as tesla valve 460. Autonomous inflow control device 400 further includes a differential pressure switch 450 including a pressure signal 452 from upstream side 435*a* biasing valve element 428 to the open position, a pressure signal 454 from downstream side 435*b* biasing valve element 428 to the open position and a pressure signal 456 from secondary fluid pathway 438 biasing valve element 428 to the closed position.

In FIG. 10A, a high viscosity fluid, such as oil, is being produced through autonomous inflow control device 400 and is represented by solid arrows 458. As discussed herein, viscosity sensitive channel 438*b* has a large influence on the velocity of a high viscosity fluid flowing therethrough such that the magnitude of pressure signal 456 will cause differential pressure switch 450 to operate valve element 428 to the open position, as indicated by the high volume of arrows 458 passing through autonomous inflow control device 400. In the illustrated configuration, tesla valve 460 has little or no effect on fluids flowing in the production direction.

In FIG. 10B, a low viscosity fluid, such as water, is being produced through autonomous inflow control device 400 and is represented by hollow arrows 462. As discussed herein, viscosity sensitive channel 438*b* has a small influence on the velocity of a low viscosity fluid flowing therethrough such that the magnitude of pressure signal 456 will cause differential pressure switch 450 to operate valve element 428 to the closed position, as indicated by the low volume of arrows 462 passing through autonomous inflow control device 400, which may represent flow passing only through secondary fluid pathway 438. In the illustrated configuration, tesla valve 460 has little or no effect on fluids flowing in the production direction.

In FIG. 10C, a treatment fluid represented by solid arrows 464 is being pumped from the surface through autonomous inflow control device 400 for injection into the surrounding formation or wellbore. Tesla valve 460 provides significant resistance to fluid flow in the injection direction creating a significant pressure loss in fluid flowing therethrough such that the magnitude of pressure signal 456 will cause differential pressure switch 450 to operate valve element 428 to the open position, as indicated by the high volume of arrows 464 passing through autonomous inflow control device 400.

Figure 11A:
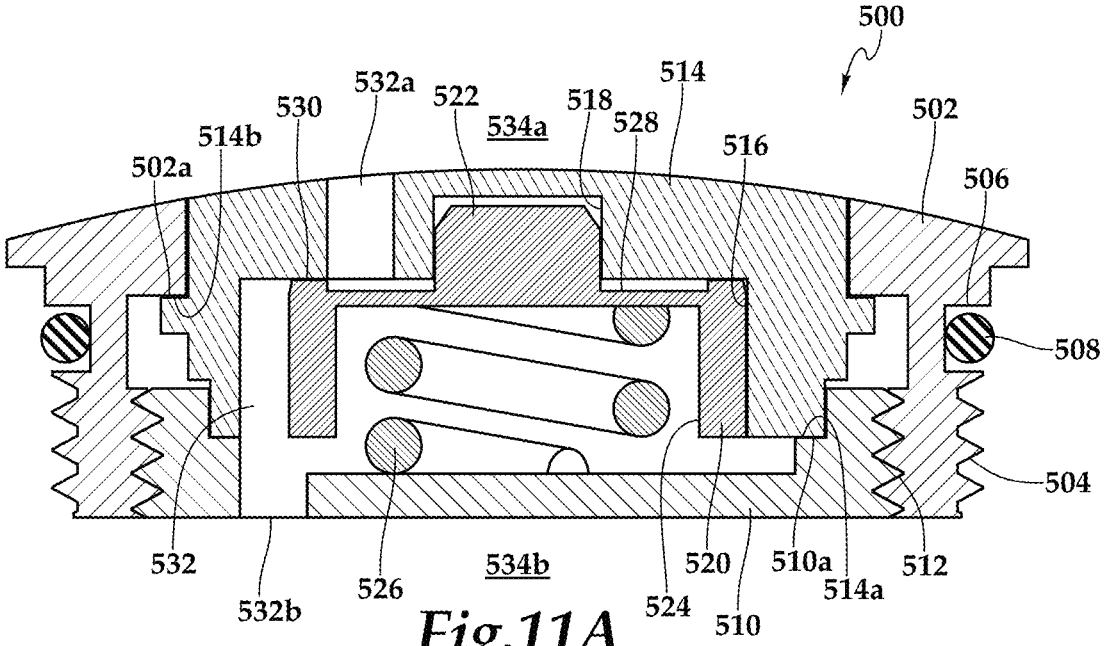
FIGS. 11A-11B are cross sectional views of a bypass valve in a closed position and an open position, respectively, according to embodiments of the present disclosure.
Figure 11B:
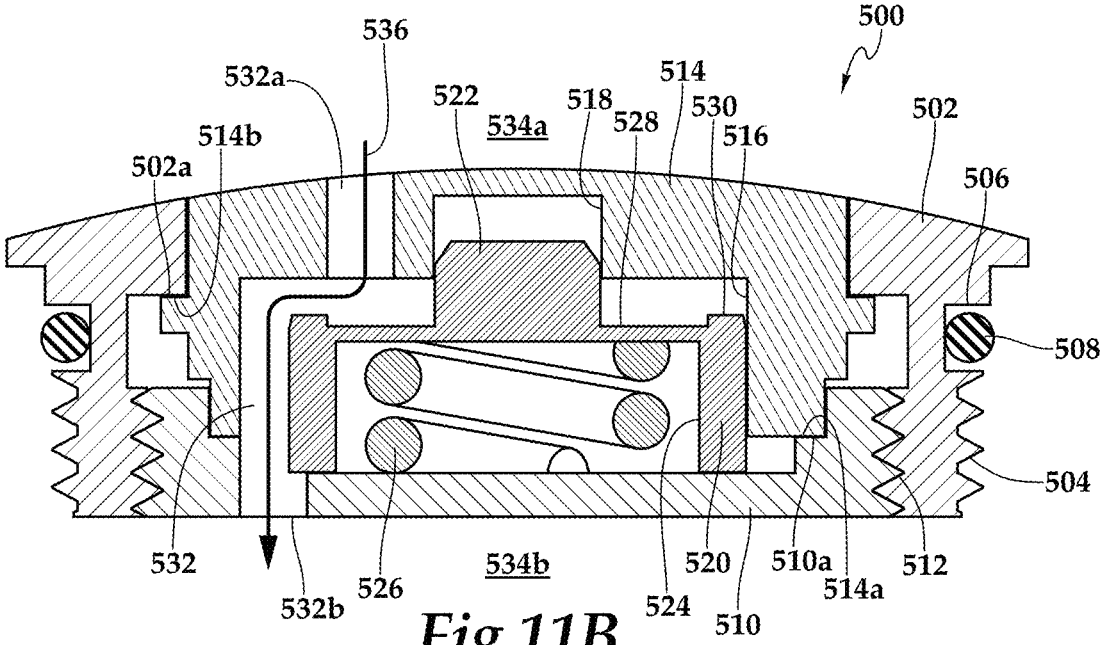

Referring next to FIGS. 11A-11B, a bypass valve for use in a downhole fluid flow control system of the present disclosure is representatively illustrated and generally designated 500. Bypass valve 500 includes a generally cylindrical housing member 502 that has outer threads 504 and an O-ring gland 506 that is configured to receive a seal 508 therein. Housing member 502 may thus be threadably and sealing coupled to a base pipe via outer threads 504 and seal 508. Bypass valve 500 includes a base 510 that is coupled to housing member 502 at threaded connection 512. Bypass valve 500 includes a housing cap 514 that is secured between base 510 and housing member 502. More specifically, a lower annular shoulder 514*a* of housing cap 514 is supported by an upper annular shoulder 510*a* of base 510 such that when base 510 and housing member 502 are fully assembled, an upper annular shoulder 514*b* of housing cap 514 forms a metal-to-metal seal against a lower annular shoulder 502*a* of housing member 502. Housing member 502, base 510 and housing cap 514 may collectively be referred to as the housing of bypass valve 500.

In the illustrated embodiment, housing cap 514 defines a generally cylindrical valve cavity 516 and a generally cylindrical guide cavity 518. A generally cylindrical valve element 520 is disposed within valve cavity 516 between base 510 and housing cap 514. Valve element 520 includes a generally cylindrical guide 522 that is received within guide cavity 518 of housing cap 514. Valve element 520 also includes a generally cylindrical spring cavity 524 that receives a biasing element depicted as a spiral wound compression spring 526 therein. Valve element 520 includes an upper annular surface 528 and an upper annular lip 530. Bypass valve 500 includes a main fluid pathway 532 that extends between an upstream side 534*a* and a downstream side 534*b* of bypass valve 500 as illustrated along streamline 536 in FIG. 11B. In the illustrated embodiment, main fluid pathway 532 includes one or more inlets 532*a* in housing cap 514 and one or more outlets 532*b* in base 510.

In operation, bypass valve 500 has a closed position as depicted in FIG. 11A in which upper annular lip 530 of valve element 520 forms a metal-to-metal seal against a lower surface of housing cap 514 responsive to the spring force applied on valve element 520 by spring 526. In the illustrated embodiment, wellbore pressure from upstream side 534*a* via inlets 532*a* acts on upper annular surface 528 to urge valve element 520 toward the open position and tubing pressure from downstream side 534*b* via outlet 532*b* acts on a lower surface of valve element 520 which, together with the spring force, urge valve element 520 toward the closed position. An opening pressure signal such as a suitable differential pressure between upstream side 534*a* and downstream side 534*b* of bypass valve 500 may be used to overcome the spring force to shift valve element 520 from the closed position (see FIG. 11A) to the open position (see FIG. 11B).

For example, when a well begins to produce a high cut of undesired fluid in most or all of the production intervals and the autonomous inflow control devices choke production along the entire completion string resulting in a low volume of oil production, if an operator wants to maintain or increase the oil production, the operator may increase drawdown pressure in an effort to increase production. The increased drawdown pressure will tend to increase the differential pressure between upstream side 534*a* and downstream side 534*b* of bypass valve 500. When the differential pressure reaches a predetermined opening differential pressure, determined at least in part by the spring force of spring 526 and the area of upper annual surface 528, valve element 520 will shift from the closed position to the open position, thereby allowing production through main fluid pathway 532 which bypasses the autonomous inflow control devices in the completion string. Once bypass valve 500 is in the open position, the operator can produce a desired volume of oil even though the production fluid has a high cut of an undesired fluid.

Valve element 520 remains in the open position until bypass valve 500 receives a closing pressure signal. For example, valve element 520 will remain in the open position as long as the differential pressure stays above the predetermined closing differential pressure which is less than the predetermined opening differential pressure. Specifically, the predetermined closing differential pressure is determined, at least in part, by the spring force and the combined areas of upper annular surface 528 and upper annular lip 530. When the differential pressure drops below the predetermined closing differential pressure, valve element 520 will shift from the open position to the closed position which stops the flow of production fluids through main fluid pathway 532. In one example, the predetermined opening differential pressure may be between 300 psi and 900 psi, such as between 400 psi and 700 psi or about 500 psi. Likewise, for example, the predetermined closing differential pressure may be between 100 psi and 400 psi, such as between 150 psi and 300 psi or about 200 psi. There should be a suitable hysteresis between the predetermined opening differential pressure and the predetermined closing differential pressure to avoid valve chatter or other unwanted valve operations. Accordingly, the hysteresis pressure may be between 200 psi and 500 psi, such as between 250 psi and 400 psi or about 300 psi.

In the illustrated embodiment, bypass valve 500 may be sequentially operated between the open and closed positioned as desired by the operate by manipulating the differential pressure between the predetermined opening differential pressure and the predetermined closing differential pressure. In other embodiments, a bypass valve of the present disclosure may not require reclosing functionality such that once the bypass valve is opened, it remains open. In the case of one-time open bypass valves, the opening pressure single may be a predetermined opening differential pressure as discussed herein or may be a predetermined tubing pressure used to operate the bypass valve from the closed position to the open position. In one example, a one-time open bypass valve may include a frangible element such as a fracture disk that is initially intact to prevent fluid flow therethrough but after receiving the opening pressure single, the frangible element is fractured or shatters to operate the bypass valve from the closed to the permanently open position. In further embodiments, instead of using an opening pressure single to operate a one-time open bypass valve of the present disclosure, an opening chemical signal could be used to dissolve a valve element initially preventing fluid flow therethrough.

The use of bypass valves together with autonomous inflow control devices in a completion string allows an operator to not only produce at a desired flowrate after water breakthrough in most or all of the production intervals, but also allows an operator to mitigate a variety of other risks associated with wells having autonomous inflow control devices deployed therein. For example, use of bypass valves together with autonomous inflow control devices allows an operator to mitigate risks associated with fluid property uncertainty including fluid viscosity inaccuracies, near wellbore uncertainty including skin damage, production plan uncertainty including plan deviations, reservoir uncertainty including permeability and saturation inaccuracies, and completion uncertainty including packer leaks. Accordingly, the use of bypass valves in wells that utilize autonomous inflow control devices improves the risk profile associated with fluid production from hydrocarbon bearing subterranean formation such that the production of the desired fluid can be maximized.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. A downhole fluid flow control system positionable in a wellbore, the flow control system comprising:

a completion string;

a plurality of flow control tubulars positioned in the completion string, each of the flow control tubulars including at least one autonomous inflow control device configured to allow production of a formation fluid when the formation fluid is a desired fluid and to choke production of the formation fluid when the formation fluid is an undesired fluid; and at least one bypass tubular positioned in the completion string, the at least one bypass tubular including at least one bypass valve, each bypass valve including a housing having at least one inlet and at least one outlet with a fluid pathway extending therebetween and a valve element disposed within the housing having open and normally closed positions;

wherein each valve element is operated from the normally closed position to the open position responsive to a predetermined opening differential pressure between a wellbore pressure and a tubing pressure to provide a path for at least a portion of the formation fluid to bypass the autonomous inflow control devices;

wherein each valve element is operated from the open position to the normally closed position responsive to a predetermined closing differential pressure between the wellbore pressure and the tubing pressure;

wherein the predetermined closing differential pressure is less than the predetermined opening differential pressure; and wherein each valve element has an upper surface with first and second areas, the wellbore pressure acting on only the first area when the valve element is in the normally closed position and the wellbore pressure acting on both the first and second areas when the valve element is in the open position.

2. The flow control system as recited in claim 1 wherein there is a greater number of the flow control tubulars than the bypass tubulars in the completion string.

3. The flow control system as recited in claim 1 wherein each of the flow control tubulars is a flow control screen assembly.

4. The flow control system as recited in claim 1 wherein each of the bypass tubulars is a bypass screen assembly.

5. The flow control system as recited in claim 1 further comprising first and second annular barriers positioned in the completion string and configured to have a sealing relationship with the wellbore to define a production interval therebetween.

6. The flow control system as recited in claim 5 wherein the flow control tubulars are positioned in the completion string between the first and second annular barriers; and wherein the at least one bypass tubular is positioned in the completion string between the first and second annular barriers.

7. The flow control system as recited in claim 1 wherein the completion string defines first and second production intervals.

8. The flow control system as recited in claim 7 wherein at least some of the flow control tubulars are positioned in the first production interval; and wherein the at least one bypass tubular is positioned in the second production interval.

9. The flow control system as recited in claim 1 wherein the predetermined opening differential pressure is between 300 psi and 900 psi.

10. The flow control system as recited in claim 1 wherein the predetermined closing differential pressure is between 100 psi and 400 psi.

11. The flow control system as recited in claim 1 wherein the difference between the predetermined opening differential pressure and the predetermined closing differential pressure is between 200 psi and 500 psi.

12. The flow control system as recited in claim 1 wherein each of the autonomous inflow control devices is configured to operate responsive to changes in a viscosity of the formation fluid.

13. The flow control system as recited in claim 1 wherein each of the autonomous inflow control devices is configured to operate responsive to changes in a density of the formation fluid.

14. A downhole fluid flow control system positionable in a wellbore, the flow control system comprising:

a completion string;

a plurality of flow control tubulars positioned in the completion string, each of the flow control tubulars including at least one autonomous inflow control device configured to allow production of a formation fluid when the formation fluid is a desired fluid and to choke production of the formation fluid when the formation fluid is an undesired fluid; and at least one bypass tubular positioned in the completion string, the at least one bypass tubular including at least one bypass valve, each bypass valve including a housing having at least one inlet and at least one outlet with a fluid pathway extending therebetween and a valve element disposed within the housing having open and normally closed positions;

wherein each valve element is operated from the normally closed position to the open position responsive to an opening pressure signal to provide a path for at least a portion of the formation fluid to bypass the autonomous inflow control devices; and wherein each valve element has an upper surface with first and second areas, a wellbore pressure acting on only the first area when the valve element is in the normally closed position and the wellbore pressure acting on both the first and second areas when the valve element is in the open position.

15. The flow control system as recited in claim 14 wherein the at least one bypass valve is operated from the open position to the closed position responsive to a closing pressure signal; and wherein the closing pressure signal is less than the opening pressure signal.

16. A downhole fluid flow control system positionable in a wellbore, the flow control system comprising:

a completion string;

a plurality of flow control tubulars positioned in the completion string, each of the flow control tubulars including at least one autonomous inflow control device configured to allow production of a formation fluid when the formation fluid is a desired fluid and to choke production of the formation fluid when the formation fluid is an undesired fluid; and at least one bypass tubular positioned in the completion string, the at least one bypass tubular including at least one bypass valve, each bypass valve including a housing having at least one inlet and at least one outlet with a fluid pathway extending therebetween and a valve element disposed within the housing having open and normally closed positions;

wherein each valve element is operable from the normally closed position to the open position to provide a path for at least a portion of the formation fluid to bypass the autonomous inflow control devices; and wherein each valve element has an upper surface with first and second areas, a wellbore pressure acting on only the first area when the valve element is in the normally closed position and the wellbore pressure acting on both the first and second areas when the valve element is in the open position.

17. The flow control system as recited in claim 16 wherein each of the flow control tubulars is a flow control screen assembly.

18. The flow control system as recited in claim 16 wherein each of the bypass tubulars is a bypass screen assembly.

19. The flow control system as recited in claim 16 wherein each of the autonomous inflow control devices is configured to operate responsive to changes in a viscosity of the formation fluid.

20. The flow control system as recited in claim 16 wherein each of the autonomous inflow control devices is configured to operate responsive to changes in a density of the formation fluid.

* * * * *